US011462158B2

(12) United States Patent
Yin

(10) Patent No.: US 11,462,158 B2
(45) Date of Patent: Oct. 4, 2022

(54) PIXEL COMPENSATION CIRCUIT, DISPLAY PANEL, DRIVING METHOD AND DISPLAY DEVICE

(71) Applicant: BOE Technology Group Co., Ltd., Beijing (CN)

(72) Inventor: Xinshe Yin, Beijing (CN)

(73) Assignee: Beijing BOE Technology Development Co., Ltd., Beijing (CN)

( * ) Notice: Subject to any disclaimer, the term of this patent is extended or adjusted under 35 U.S.C. 154(b) by 21 days.

(21) Appl. No.: 16/649,288

(22) PCT Filed: Mar. 29, 2019

(86) PCT No.: PCT/CN2019/080633
§ 371 (c)(1),
(2) Date: Mar. 20, 2020

(87) PCT Pub. No.: WO2020/199018
PCT Pub. Date: Oct. 8, 2020

(65) Prior Publication Data

US 2021/0241688 A1 Aug. 5, 2021

(51) Int. Cl.
*G09G 3/3233* (2016.01)
*G09G 3/3266* (2016.01)
*G09G 3/3275* (2016.01)

(52) U.S. Cl.
CPC ..... *G09G 3/3233* (2013.01); *G09G 3/3266* (2013.01); *G09G 3/3275* (2013.01); *G09G 2300/0426* (2013.01); *G09G 2310/0297* (2013.01); *G09G 2330/021* (2013.01)

(58) Field of Classification Search
None
See application file for complete search history.

(56) References Cited

U.S. PATENT DOCUMENTS

2002/0050962 A1* 5/2002 Kasai ..... G09G 3/3233 345/76
2004/0056605 A1 3/2004 Yoshida
(Continued)

FOREIGN PATENT DOCUMENTS

CN 1497522 A 5/2004
CN 101866619 A 10/2010
(Continued)

OTHER PUBLICATIONS

Office Action for corresponding Chinese Application No. 201980000432.3 dated Jan. 19, 2022.

*Primary Examiner* — Nitin Patel
*Assistant Examiner* — Amen W Bogale
(74) *Attorney, Agent, or Firm* — ArentFox Schiff LLP; Michael Fainberg

(57) ABSTRACT

The embodiments of the present disclosure provide a pixel compensation circuit, a display panel, a driving method and a display device. The pixel compensation circuit includes a light emitting component; a drive circuit configured to generate a drive current input to a first electrode of the light emitting component; and a light emission control circuit configured to provide a first power signal to a second electrode of the light emitting component in response to a first light emission control signal, and to provide a second power signal to the second electrode of the light emitting component in response to a second light emission control signal, wherein the first power signal and the second power signal have opposite levels.

14 Claims, 16 Drawing Sheets

(56) References Cited

U.S. PATENT DOCUMENTS

| | | | | |
|---|---|---|---|---|
| 2012/0019499 | A1 | 1/2012 | Hwang et al. | |
| 2014/0168190 | A1 | 6/2014 | Kwak et al. | |
| 2015/0179105 | A1* | 6/2015 | Mizukoshi | G09G 3/3266 345/76 |
| 2016/0125774 | A1 | 5/2016 | Hwang et al. | |
| 2017/0162119 | A1* | 6/2017 | Kim | H01L 27/3276 |
| 2017/0221420 | A1* | 8/2017 | Zhu | G09G 3/3233 |
| 2018/0005575 | A1* | 1/2018 | Lee | G09G 3/3233 |
| 2018/0082637 | A1* | 3/2018 | Zhang | G09G 3/3258 |
| 2018/0181242 | A1* | 6/2018 | Mizuhashi | G06F 3/04184 |
| 2018/0218680 | A1 | 8/2018 | Cai | |
| 2018/0218681 | A1 | 8/2018 | Cai | |
| 2019/0005886 | A1* | 1/2019 | Lee | G09G 3/3258 |
| 2019/0019452 | A1* | 1/2019 | Zhu | G09G 3/3266 |
| 2019/0156759 | A1* | 5/2019 | Wang | G09G 3/3258 |
| 2020/0202797 | A1* | 6/2020 | Cho | G09F 9/301 |
| 2021/0020105 | A1* | 1/2021 | Yin | G09G 3/3275 |
| 2021/0335234 | A1* | 10/2021 | Yin | G09G 3/3291 |

FOREIGN PATENT DOCUMENTS

| | | | |
|---|---|---|---|
| CN | 102005182 | A | 4/2011 |
| CN | 103886827 | A | 6/2014 |
| CN | 104200778 | A | 12/2014 |
| CN | 104732920 | A | 6/2015 |
| CN | 106205494 | A | 12/2016 |
| CN | 106205495 | A | 12/2016 |
| CN | 107833557 | A | 3/2018 |

* cited by examiner

PIXEL COMPENSATION CIRCUIT, DISPLAY PANEL, DRIVING METHOD AND DISPLAY DEVICE

The present application is a US National Stage of International Application No. PCT/CN2019/080633, filed Mar. 29, 2019, which is hereby incorporated by reference in its entirety.

FIELD

The present disclosure relates to the technical field of display, and particularly to a pixel compensation circuit, a display panel, a driving method and a display device.

BACKGROUND

Organic light emitting diode (OLED) display panels have the advantages of low energy consumption and self-luminescence, and are one of the hotspots in the research field of flat display panels. Since an OLED is driven by the current, a stable current is needed to control its luminescence. Generally, OLED display panels use pixel compensation circuits to generate a drive current to drive the OLED to emit light.

SUMMARY

Embodiments of the present disclosure provide a pixel compensation circuit. The pixel compensation circuit includes: a light emitting component; a drive circuit configured to generate a drive current input to a first electrode of the light emitting component; and a light emission control circuit configured to provide a first power signal to a second electrode of the light emitting component in response to a first light emission control signal, and to provide a second power signal to the second electrode of the light emitting component in response to a second light emission control signal, wherein the first power signal and the second power signal have opposite levels.

Optionally, in the embodiments of the present disclosure, the drive circuit and the light emitting components are in a display area of a display panel, and the light emission control circuit is in a non-display area of the display panel.

Optionally, in the embodiments of the present disclosure, the light emission control circuit includes a first transistor and a second transistor; a gate of the first transistor is configured to receive the first light emission control signal, a first electrode of the first transistor is configured to receive the first power signal, and a second electrode of the first transistor is coupled to the second electrode of the light emitting component; and a gate of the second transistor is configured to receive the second light emission control signal, a first electrode of the second transistor is configured to receive the second power signal, and a second electrode of the second transistor is coupled to the second electrode of the light emitting component.

Optionally, in the embodiments of the present disclosure, the first light emission control signal and the second light emission control signal are the same signal, and transistor types of the first transistor and the second transistor are different.

Optionally, in the embodiments of the present disclosure, the first light emission control signal is different from the second light emission control signal, and the transistor types of the first transistor and the second transistor are the same.

Optionally, in the embodiments of the present disclosure, the drive circuit includes a drive transistor, a third transistor, a fourth transistor, a first capacitor, and a second capacitor; a gate of the drive transistor is coupled to a first terminal of the first capacitor, a first electrode of the drive transistor is configured to receive the first power signal, and a second electrode of the drive transistor is coupled to the first electrode of the light emitting component; a gate of the third transistor is coupled to a scanning signal terminal, a first electrode of the third transistor is coupled to a data signal terminal, and a second electrode of the third transistor is coupled to the gate of the drive transistor; a gate of the fourth transistor is coupled to a reset signal terminal, a first electrode of the fourth transistor is coupled to an initialization signal terminal, and a second electrode of the fourth transistor is coupled to the first electrode of the light emitting component; a second terminal of the first capacitor is coupled to the first electrode of the light emitting component; and a first terminal of the second capacitor is configured to receive the first power signal, and a second terminal of the second capacitor is coupled to the first electrode of the light emitting component.

Correspondingly, the embodiments of the present disclosure also provide a display panel, which includes a base substrate and a plurality of pixel compensation circuits, wherein the base substrate includes a display area and a non-display area surrounding the display area; and the drive circuits and light emitting components in the pixel compensation circuits are in the display area of the base substrate.

Optionally, in the embodiments of the present disclosure, the light emission control circuits are in the non-display area.

Optionally, in the embodiments of the present disclosure, the display panel further includes at least one of a driving chip, a flexible printed circuit, and a printed circuit board; and the light emission control circuits are in at least one of the driving chip, the flexible printed circuit and the printed circuit board.

Optionally, in the embodiments of the present disclosure, the display area includes a plurality of sub-display areas, and all the light emitting components in each sub-display area are coupled to the same light emission control circuit.

Optionally, in the embodiments of the present disclosure, each of the sub-display areas corresponds to one of the light emission control circuits, and the light emission control circuits are arranged in the corresponding sub-display areas respectively on the base substrate.

Optionally, in the embodiments of the present disclosure, each of the sub-display areas extends in a first direction, the sub-display areas are arranged in a second direction, and the first direction crosses the second direction.

Optionally, in the embodiments of the present disclosure, the sub-display areas are distributed in a matrix arrangement.

Optionally, in the embodiments of the present disclosure, all the pixel compensation circuits share one light emission control circuit.

Optionally, in the embodiments of the present disclosure, the display panel further includes a plurality of gate lines, a gate drive circuit, and multiplexer circuits one-to-one corresponding to the gate lines; each of the gate lines is coupled to a signal output terminal of the gate drive circuit through the corresponding multiplexer circuit; and the multiplexer circuit is configured to connect a fixed voltage signal terminal to the corresponding gate line in response to a conduction control signal having a first level, and connect the connected signal output terminal to the corresponding gate line in response to a conduction control signal having a second level.

Optionally, in the embodiments of the present disclosure, the conduction control signals received by the multiplexer circuits are the same signal.

Correspondingly, the embodiments of the present disclosure also provide a display device, which includes the display panel described above.

Correspondingly, the embodiments of the present disclosure also provide a driving method of the display panel, wherein in one frame time, the method includes: in a non-light emitting period, at least part of light emission control circuits provide first power signals to second electrodes of light emitting components in response to first light emission control signals; and in a light emitting period, at least part of the light emission control circuits provide second power signals to the second electrodes of the light emitting components in response to second light emission control signals, and all drive circuits generate drive currents input to first electrodes of the light emitting components to drive the light emitting components to emit light.

Optionally, in the embodiments of the present disclosure, in the non-light emitting period, the method includes: in a reset period, all third transistors are turned on simultaneously in response to signals of scanning signal terminals, to provide reference voltage signals of data signal terminals to gates of drive transistors, and all fourth transistors are turned on simultaneously in response to signals of reset signal terminals, to provide signals of initialization signal terminals to the first electrodes of the light emitting components; in a threshold compensation period, all the third transistors are turned on simultaneously in response to the signals of the scanning signal terminals, to provide the reference voltage signals of the data signal terminals to the gates of the drive transistors, and all the drive transistors are turned on simultaneously to write threshold voltages of the drive transistors into second electrodes of the drive transistors; and in a data writing period, the third transistors are turned on row by row in response to the signals of the scanning signal terminals, to provide data signals of the data signal terminals to the gates of the drive transistors, and to write voltages of the data signals into the second electrodes of the drive transistors through first capacitors and second capacitors.

DETAILED DESCRIPTION

Figure 1:
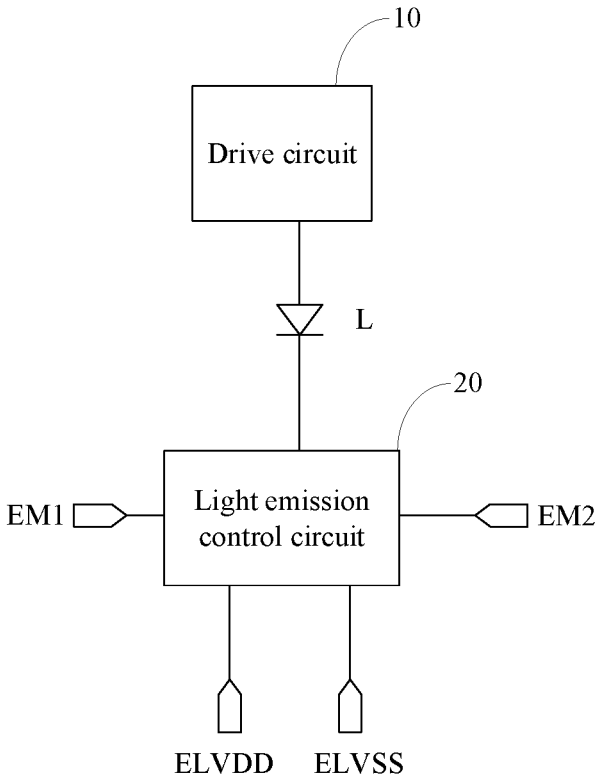
FIG. 1 is a schematic structural diagram of a pixel compensation circuit in accordance with an embodiment of the present disclosure.

In order to make the objects, technical solutions and advantages of the present disclosure clearer, the specific implementation of a pixel compensation circuit, a display panel, a driving method and a display device according embodiments of the present disclosure will be described in detail below with reference to accompanying drawings. It should be understood that the preferred embodiments described below are only used to illustrate and explain the present disclosure and are not used to limit the present disclosure. Besides, the embodiments in the present disclosure and the features in the embodiments may be combined with each other without conflict. It should be noted that the sizes and shapes of figures in the drawings do not reflect true proportions, and are only for the purpose of schematically illustrating contents of the present disclosure. The same or similar reference numerals refer to the same or similar elements or elements having the same or similar functions throughout.

Generally, a drive transistor in a pixel compensation circuit generates a drive current and provides the drive current to an OLED to drive the OLED to emit light. However, due to some factors such as manufacturing processes and device aging, the threshold voltage $V_{th}$ of the drive transistor is non-uniform, which causes the drive current to change and display brightness to be non-uniform, thus affecting the display effect of an entire image. In order to improve the stability of the drive current, a pixel compensation circuit capable of compensating for the threshold voltage $V_{th}$ can be used to generate the drive current. However, in order to avoid the influence of the pixel compensation circuit on display during threshold voltage $V_{th}$ compensation, a non-light emitting period is set in one frame time so that compensation for the threshold voltage $V_{th}$ can be performed in the non-light emitting period. However, in order to realize the non-light emitting period, the pixel compensation circuit needs to be provided with a large number of transistors. This will lead to great process difficulty, increased production cost, and a large area occupied by the pixel compensation circuit, which is not conducive to a high resolution of a display panel.

In view of this, the embodiments of the present disclosure provide a pixel compensation circuit with a simple structure, which can reduce the process difficulty, reduce the production cost, and reduce the occupied area of the pixel compensation circuit, thus facilitating the high resolution of the display panel.

The embodiments of the present applicant provide some pixel compensation circuits. As shown in FIG. 1, the pixel compensation circuit may include a light emitting component L, a drive circuit 10, and a light emission control circuit 20. The drive circuit 10 is configured to generate a drive current input to a first electrode of the light emitting component L. The light emission control circuit 20 is configured to provide a first power signal ELVDD to a second electrode of the light emitting component L in response to a first light emission control signal EM1 and to provide a second power signal ELVSS to the second electrode of the light emitting component L in response to a second light emission control signal EM2, wherein the first power signal ELVDD and the second power signal ELVSS have opposite levels.

In the pixel compensation circuit according to the embodiments of the present disclosure, the light emission control circuit provides the first power signal to the second electrode of the light emitting component in response to the first light emission control signal in a non-light emitting period, so as to control the light emitting component not to emit light. In a light emitting period, the drive circuit generates the drive current to input to the first electrode of the light emitting component, and the light emission control circuit provides the second power signal to the second electrode of the light emitting component in response to the second light emission control signal, so that the drive current drives the light emitting component to emit light. Therefore, a simple structure can be adopted to control whether the light emitting components emits light, thereby reducing the process difficulty, reducing the production cost, reducing the occupied area of the pixel compensation circuit and being beneficial to the high resolution of the display panel.

Generally, the light emitting component has a turn-on voltage and emits light when the voltage difference between the first electrode and the second electrode of the light emitting component is greater than or equal to the turn-on voltage. In implementation, the first electrode of the light emitting component is electrically connected with the drive circuit, and the second electrode of the light emitting component is electrically connected with the light emission control circuit. In the embodiments of the present disclosure, the light emitting component may include an electroluminescent diode. An anode of the electroluminescent diode serves as the first electrode of the light emitting component and a cathode of the electroluminescent diode serves as the second electrode of the light emitting component. Specifically, the electroluminescent diode may include an OLED, or a quantum dot light emitting diode (QLED).

In implementation, in the embodiments of the present disclosure, the drive circuit and the light emitting component may be configured in a display area of the display panel to enable the display panel to display pictures.

In implementation, in the embodiments of the present disclosure, the light emission control circuit may be located in a non-display area of the display panel, so as to reduce the space occupied in the display area. The light emission control circuit may be located in the non-display area around the display area in a base substrate of the display panel. Alternatively, the light emission control circuit may be in at least one of a driving chip, a flexible printed circuit and a printed circuit board in the display panel.

In implementation, in the embodiments of the present disclosure, the first power signal ELVDD may be a high-level voltage signal, for example, the voltage $V_{dd}$ of the first power signal ELVDD is generally positive. The second power signal ELVSS may be a low-level voltage signal, for example, the voltage $V_{ss}$ of the second power signal ELVSS is generally a ground voltage or negative. In actual application, the above voltages need to be designed and determined according to the actual application environment, and are not limited here.

Figure 2:
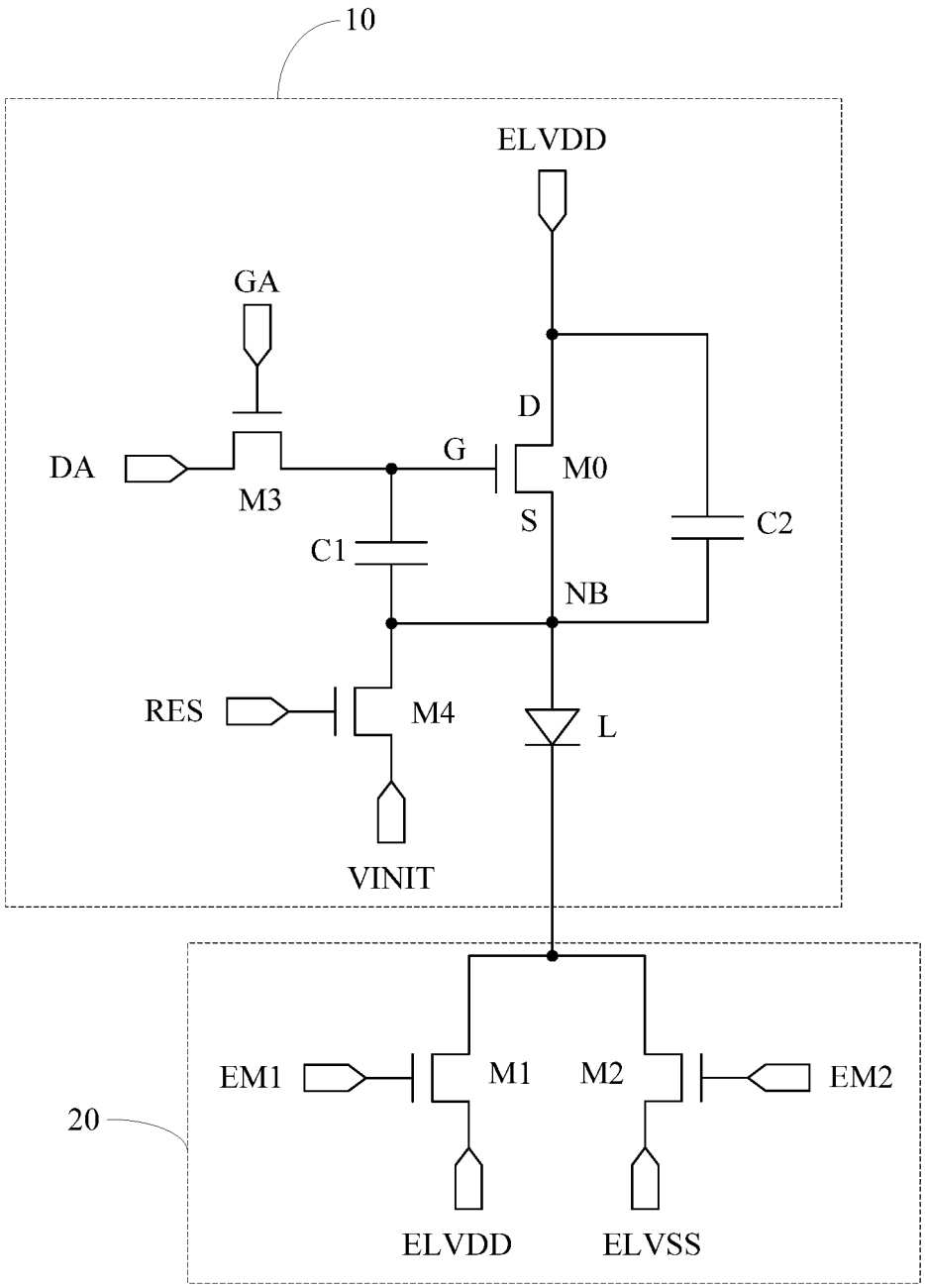
FIG. 2 is a first schematic detailed structural diagram of a pixel compensation circuit in accordance with an embodiment of the present disclosure.

In implementation, in the embodiments of the present disclosure, as shown in FIG. 2, the drive circuit 10 may include a drive transistor M0, a third transistor M3, a fourth transistor M4, a first capacitor C1, and a second capacitor C2.

A gate G of the drive transistor M0 is coupled to a first terminal of the first capacitor C1, a first electrode D of the drive transistor M0 is configured to receive the first power signal ELVDD, and a second electrode S of the drive transistor M0 is coupled to the first electrode of the light emitting component L. A gate of the third transistor M3 is coupled to a scanning signal terminal GA, a first electrode of the third transistor M3 is coupled to a data signal terminal DA, and a second electrode of the third transistor M3 is coupled to the gate G of the drive transistor M0; a gate of the fourth transistor M4 is coupled to a reset signal terminal RES, a first electrode of the fourth transistor M4 is coupled to an initialization signal terminal VINIT, and a second electrode of the fourth transistor M4 is coupled to the first electrode of the light emitting component L; a second terminal of the first capacitor C1 is coupled to the first electrode of the light emitting component L; and a first terminal of the second capacitor C2 is configured to receive the first power signal ELVDD, and a second terminal of the second capacitor C2 is coupled to the first electrode of the light emitting component L.

In implementation, in the embodiments of the present disclosure, as shown in FIG. 2, the drive transistor M0 may be an N-type transistor, wherein the first electrode D of the drive transistor M0 serves as its drain and the second electrode S of the drive transistor M0 serves as its source. When the drive transistor M0 is in a saturation state, the current flows from the drain of the drive transistor M0 to its source. Moreover, the light emitting component L generally emits light under the current when the drive transistor M0 is in a saturation state. Of course, in the embodiments of the present disclosure, the drive transistor is illustrated as an N-type transistor, and for the case where the drive transistor is a P-type transistor, the design principle is the same as that of the present disclosure, and this case also falls within the scope of protection of the present disclosure.

Generally, transistors using low temperature poly-silicon (LTPS) materials as active layers have high mobility, can be made thinner and smaller, and have lower power consumption. In implementation, the material of an active layer of the drive transistor may be an LTPS material.

In implementation, in the embodiments of the present disclosure, when the third transistor M3 is turned on under the control of a signal of the scanning signal terminal GA, a signal of the data signal terminal DA may be provided to the gate of the drive transistor M0. When the fourth transistor M4 is turned on under the control of a signal of the reset signal terminal RES, a signal of the initialization signal terminal VINIT may be provided to the first electrode of the light emitting component L. The first capacitor C1 may store signals input to its first and second terminals, and may couple the signal input to the gate of the drive transistor to the second terminal of the first capacitor C1 when the second terminal of the first capacitor C1 is floating. The second capacitor C2 may store signals input to its first and second terminals and divide the voltage of the signal coupled to the second terminal of the first capacitor C1.

Generally, the leakage current of a transistor using a metal oxide semiconductor material as an active layer is small. In order to reduce the leakage current of the gate G of the drive transistor M0, in implementation, in the embodiments of the present disclosure, the material of an active layer of the third transistor M3 may be a metal oxide semiconductor material, for example, an indium gallium zinc oxide (IGZO). Of course, the material of the active layer can also be other materials capable of realizing the solution of the present disclosure, which is not limited here.

In order to reduce the leakage current at the second terminal of the first capacitor C1, in implementation, in the embodiments of the present disclosure, the material of an active layer of the fourth transistor M4 may be a metal oxide semiconductor material, for example, an indium gallium zinc oxide (IGZO). Of course, the material of the active layer can also be other materials capable of realizing the solution of the present disclosure, which is not limited here.

In implementation, in the embodiments of the present disclosure, as shown in FIG. 2, the light emission control circuit 20 may include a first transistor M1 and a second transistor M2, wherein a gate of the first transistor M1 is configured to receive the first light emission control signal EM1, a first electrode of the first transistor M1 is configured to receive the first power signal ELVDD, and a second electrode of the first transistor M1 is coupled to the second electrode of the light emitting component L; and a gate of the second transistor M2 is configured to receive the second light emission control signal EM2, a first electrode of the second transistor M2 is configured to receive the second power signal ELVSS, and a second electrode of the second transistor M2 is coupled to the second electrode of the light emitting component L.

In implementation, in the embodiments of the present disclosure, when the first transistor M1 is turned on under the control of the first light emission control signal EM1, the first power signal ELVDD may be provided to the second electrode of the light emitting component L, so that the light emitting component L does not emit light. When the second transistor M2 is turned on under the control of the second light emission control signal EM2, the second power signal ELVSS may be provided to the second electrode of the light emitting component L, so that the light emitting component L receives a low-level voltage and emits light normally.

Figure 3:
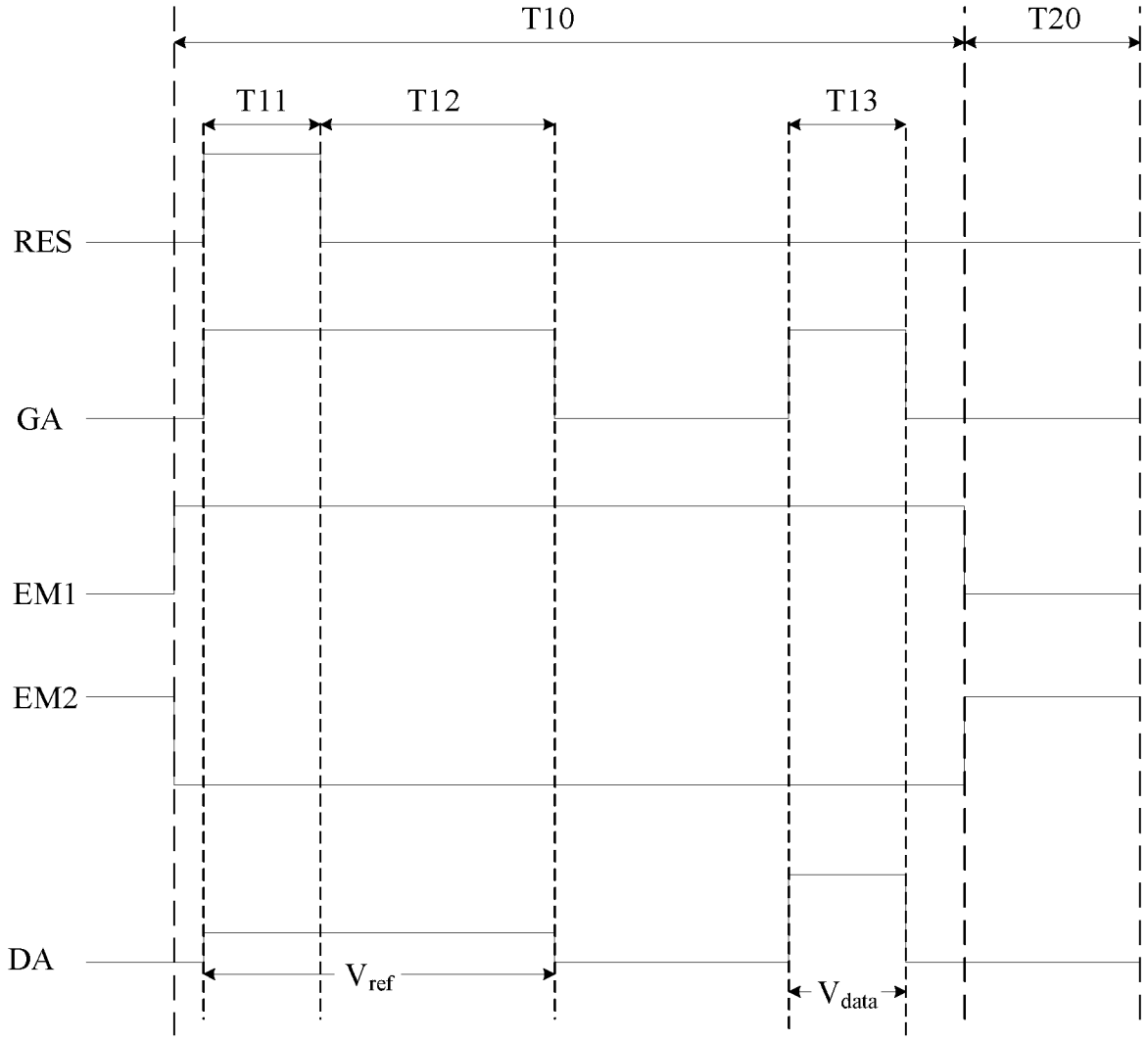
FIG. 3 is a first signal timing diagram in accordance with an embodiment of the present disclosure.

In implementation, in the embodiments of the present disclosure, as shown in FIG. 2, the first light emission control signal EM1 is different from the second light emission control signal EM2, and the transistor types of the first transistor M1 and the second transistor M2 are the same. For example, as shown in FIG. 2, the first transistor M1 and the second transistor M2 are both N-type transistors, and the first light emission control signal EM1 and the second light emission control signal EM2 are as shown in FIG. 3.

In order to simplify a preparation process, in specific implementation, in the embodiments of the present disclosure, as shown in FIG. 2, the first to fourth transistors M1 to M4 may all be N-type transistors.

In implementation, the material of an active layer of the first transistor M1 may be an LTPS material or a metal oxide semiconductor material, which is not limited here.

In implementation, the material of an active layer of the second transistor M2 may be an LTPS material or a metal oxide semiconductor material, which is not limited here.

It should be noted that the above transistors may be bottom gate transistors or top gate transistors, which needs to be designed and determined according to the actual application environment, and is not limited here.

In implementation, the first electrodes of the above transistors can be used as the sources thereof and the second electrodes can be used as the drains thereof, alternatively, the first electrodes serve as the drains thereof and the second electrodes serve as the sources, and no specific distinction is made here.

Further, in implementation, the N-type transistor is turned on under the high-level signal and turned off under the low-level signal. The P-type transistor is turned off under the high-level signal and turned on under the low-level signal.

The above is only to illustrate the structure of the pixel compensation circuit according to the embodiments of the present disclosure. In implementation, the structures of the above drive circuit and light emission control circuit are not limited to the above structures provided by the embodiments of the present disclosure, but may be other structures known to those skilled in the art, which is not limited here.

Taking the pixel compensation circuit shown in FIG. 2 as an example, the operation process of the pixel compensation circuit according to the embodiments of the present disclosure will be described below in conjunction with the signal timing diagram shown in FIG. 3. In the following description, a high-level signal is denoted by 1 and a low-level signal is denoted by 0. It should be noted that 1 and 0 are logic levels, which are only for better explanation of the specific operation process of the embodiments of the present disclosure, rather than the voltage applied to the gates of the transistors during specific implementation.

One frame time may include a non-light emitting period T10 and a light emitting period T20. The non-light emitting period T10 may include a reset period T11, a threshold compensation period T12, and a data writing period T13.

In the non-light emitting period T10, since EM1=1, the first transistor M1 is turned on, to provide the first power signal ELVDD to the second electrode of the light emitting component L, so that the voltage of the second electrode of the light emitting component L is $V_{dd}$, thereby causing the light emitting component L to be in a negative bias state and not emit light. Since EM2=0, the second transistor M2 is turned off.

In the reset period T11, RES=1 and GA=1.

Since GA=1, the third transistor M3 is turned on, to provide a reference voltage signal input from the data signal terminal DA to the gate G of the drive transistor M0, so that the voltage of the gate G of the drive transistor M0 is the voltage $V_{ref}$ of the reference voltage signal. Since RES=1, the fourth transistor M4 is turned on, to provide an initialization signal input from the initialization signal terminal VINIT to the first electrode of the light emitting component L, so that the voltage of the first electrode of the light emitting component L is the voltage $V_{init}$ of the initialization signal. Therefore, the voltage difference across the first capacitor C1 is $V_{ref}-V_{init}$. The voltage difference across the second capacitor C2 is $V_{dd}-V_{init}$. In addition, in order to ensure that the drive transistor M0 can be turned on in the threshold compensation period, $V_{ref}$ and $V_{init}$ can satisfy the relationship: $V_{ref}>V_{init}+V_{th}$, wherein $V_{th}$ represents the threshold voltage of the drive transistor M0. Moreover, in order to prevent the light emitting component L from emitting light, $V_{init}$ and $V_{dd}$ can satisfy the relationship: $V_{init}<V_{dd}$.

In the threshold compensation period T12, RES=0 and GA=1.

Since GA=1, the third transistor M3 is turned on, to provide the reference voltage signal input from the data signal terminal DA to the gate G of the drive transistor M0, so that the voltage of the gate G of the drive transistor M0 continues to be the voltage $V_{ref}$ of the reference voltage signal. Since RES=0, the fourth transistor M4 is turned off. At the moment when the fourth transistor M4 is turned off, the voltage difference across the first capacitor C1 can still be kept at $V_{ref}-V_{init}$. Since $V_{ref}>V_{init}+V_{th}$, the drive transistor M0 can be turned on to generate a current flowing from the first electrode D to the second electrode S, so as to charge the first capacitor C1 and the second capacitor C2 by the current, thus making the voltages of the second terminal of the first capacitor C1 and the second terminal of the second capacitor C2 (i.e., the voltage at the point NB) gradually rise. When the voltage $V_{NB1}$ at the point NB rises to $V_{ref}-V_{th}$, the drive transistor M0 is turned off. At this point, the voltage difference across the first capacitor C1 is $V_{th}$. Moreover, when the voltage at the point NB rises to $V_{ref}-V_{th}$, the charge $Q_{NBT12}$ at the point NB can satisfy the formula: $Q_{NBT12}=c2(V_{NB1}-V_{dd})+c1(V_{NB1}-V_{ref})+cL(V_{NB1}-V_{dd})=(c2+cL)(V_{ref}-V_{th}-V_{dd})-c1V_{th}$, wherein c1 represents a capacitance value of the first capacitor C1, c2 represents a capacitance value of the second capacitor C2, and cL represents a capacitance value between the first electrode and the second electrode of the light emitting component L. In addition, in order to prevent the light emitting component L from emitting light, $V_{ref}-V_{th}<V_{dd}$ may be satisfied.

In the data writing period T13, RES=0 and GA=1.

Since RES=0, the fourth transistor M4 is turned off. Since GA=1, the third transistor M3 is turned on, to provide the data signal input from the data signal terminal DA to the gate G of the drive transistor M0 and charge the first capacitor C1 and the second capacitor C2. After balancing, the voltage of the gate G of the drive transistor M0 is the voltage $V_{DA}$ of the data signal, and the voltage at the point NB is $V_{NB2}$. Then in this time, the charge $Q_{NBT13}$ at the point NB can satisfy the formula: $Q_{NBT12}=(c2+cL)(V_{NB2}-V_{dd})-c1(V_{data}-V_{NB2})$. In the process of data signal input, the point NB has neither charge inflow nor charge outflow, so $Q_{NBT13}=Q_{NBT12}$. Therefore, $$V_{NB2} = \frac{c1^{*}V_{data} + (c2 + cL)V_{ref}}{c1 + c2 + cL} - V_{th}.$$

In the light emitting period T20, since EM1=0, the first transistor M1 is turned off. Since RES=0, the fourth transistor M4 is turned off. Since GA=0, the third transistor M3 is turned off. Since EM2=1, the second transistor M2 is turned on, to provide the second power signal ELVSS to the second electrode of the light emitting component L, so that the voltage of the second electrode of the light emitting component L is $V_{ss}$, thus making the light emitting component L in a positive bias state. The drive transistor M0 generates the drive current $I_L$ under the control of the voltage $V_{NB2}$ of its second electrode S and the voltage $V_{DA}$ of its gate G, $$I_L = K(V_{data} - V_{NB2} - V_{th})^2 = K\left(\frac{cL + c2}{cL + c1 + c2}\right)^2 (V_{data} - V_{ref})^2,$$

wherein $$K = \frac{1}{2}\mu_n C_{ox}\frac{W}{L},$$

$\mu_n$ represents the mobility of the drive transistor M0, $C_{ox}$ is the gate oxide capacitance per unit area, and $$\frac{W}{L}$$

is the width-to-length ratio of the drive transistor M0. These values are relatively stable in the same structure and can be counted as constants. In this way, the light emitting component L can be driven to emit light by the drive current $I_L$.

Due to some factors such as manufacturing processes and device aging, the threshold voltage $V_{th}$ of the drive transistor may drift, thus causing the drive current flowing through each light emitting component to change under the influence of $V_{th}$ drift, resulting in uneven display brightness, which further affects the display effect of the entire image. According to the above formula of the drive current $I_L$, the drive current $I_L$ is only related to the voltage $V_{data}$ of the data signal input from the data signal terminal DA and the voltage $V_{ref}$ of the reference voltage signal, and is not related to the threshold voltage $V_{th}$ of the drive transistor M0. Therefore, the influence of the drift of the threshold voltage $V_{th}$ on the drive current $I_L$ caused by the manufacturing process and long-term operation of the drive transistor M0 can be avoided, so that the drive current $I_L$ of the light emitting component L is kept stable, and the normal operation of the light emitting component L is further ensured.

In addition, a buffer period may be provided between the threshold compensation period T12 and the data writing period T13 so that $V_{data}$ can be written after the voltage difference across the first capacitor C1 is stabilized, which further improves the circuit stability.

As can be seen from the above embodiments, the present disclosure can prevent the light emitting component from emitting light in the threshold compensation period and the data writing period through the simple structure of the pixel compensation circuit, thereby avoiding afterimages.

Figure 4:
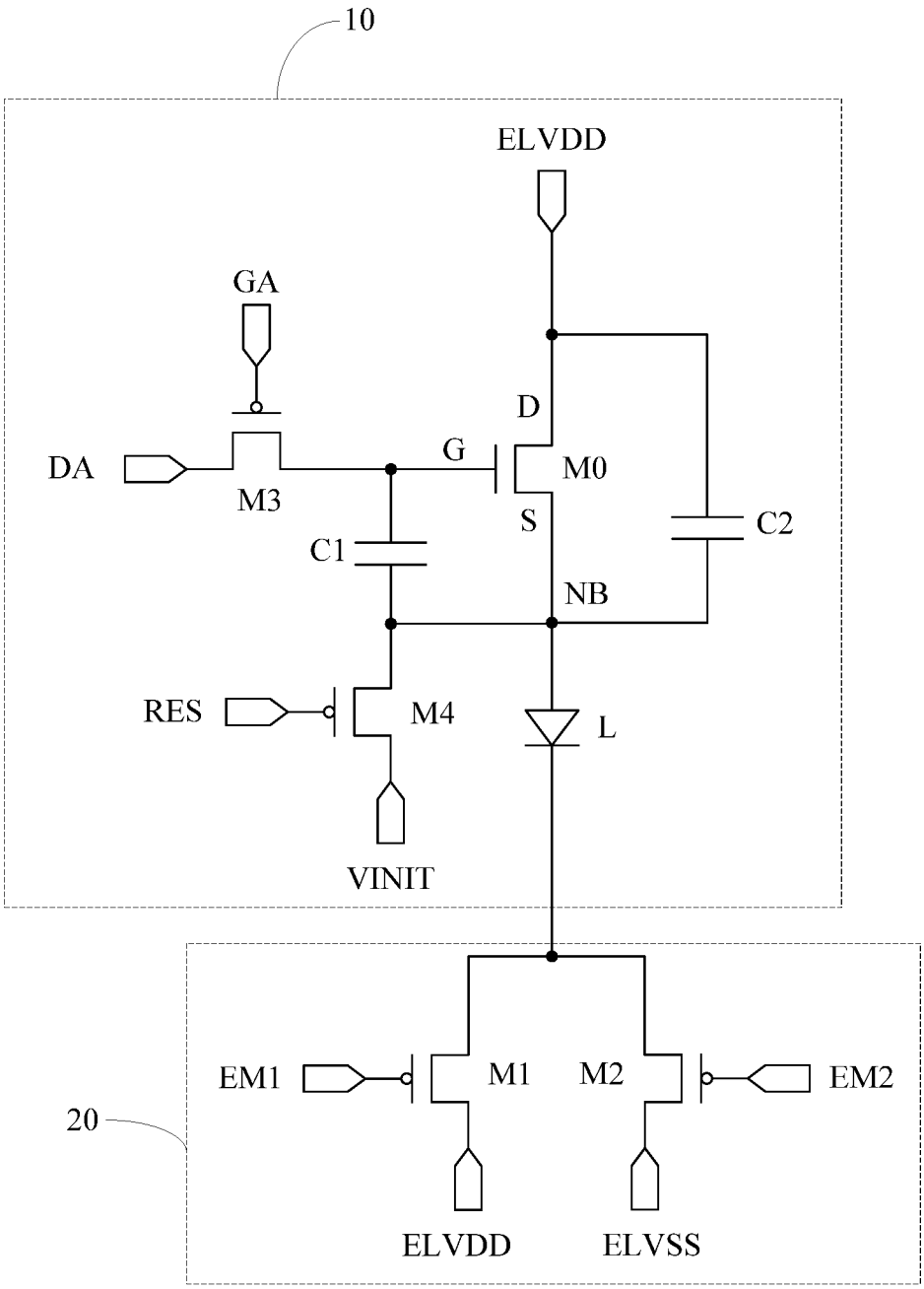
FIG. 4 is a second schematic detailed structural diagram of a pixel compensation circuit in accordance with an embodiment of the present disclosure.

The embodiments of the present disclosure provide other pixel compensation circuits, as shown in FIG. 4, which are modified to the embodiment shown in FIG. 2. Next, only the differences between the present embodiment and the embodiment of the pixel compensation circuit shown in FIG. 2 will be explained, and the similarities will not be repeated here.

Figure 5:
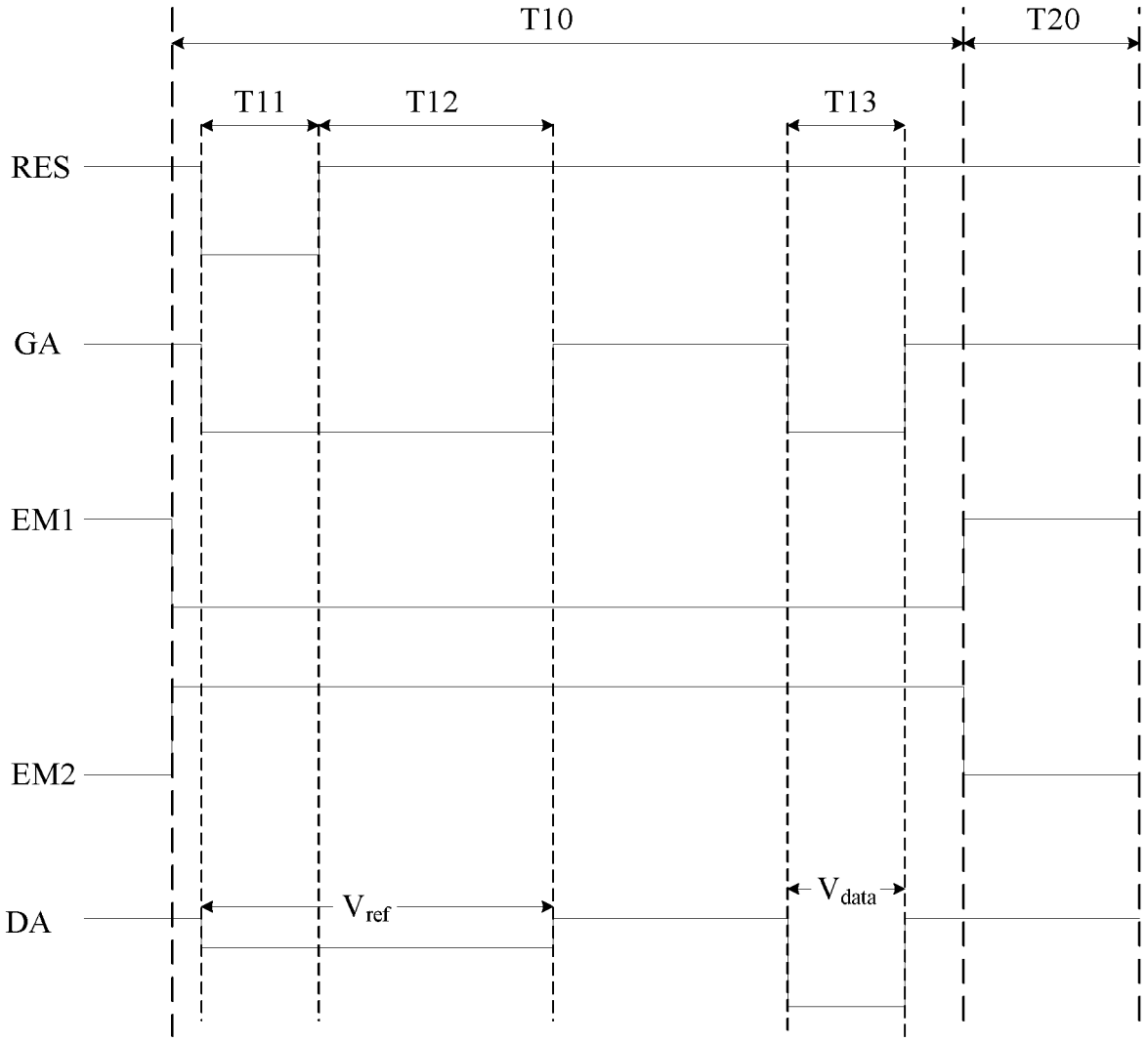
FIG. 5 is a second signal timing diagram in accordance with an embodiment of the present disclosure.

In implementation, in the embodiments of the present disclosure, as shown in FIG. 4, the first light emission control signal EM1 is different from the second light emission control signal EM2, and the transistor types of the first transistor M1 and the second transistor M2 are the same. For example, the first transistor M1 and the second transistor M2 are both P-type transistors, and the first light emission control signal EM1 and the second light emission control signal EM2 are as shown in FIG. 5. Further, in order to simplify the manufacturing process, the first to fourth transistors M1 to M4 may be all P-type transistors, which is not limited here.

Taking the pixel compensation circuit shown in FIG. 4 as an example, the operation process of the pixel compensation circuit according to the embodiments of the present disclosure will be described below in conjunction with the signal timing diagram shown in FIG. 5. In the following description, a high-level signal is denoted by 1 and a low-level signal is denoted by 0. It should be noted that 1 and 0 are logic levels, which are only for better explanation of the operation process of the embodiments of the present disclosure, rather than the voltage applied to the gates of the transistors during implementation.

One frame time may include a non-light emitting period T10 and a light emitting period T20. The non-light emitting period T10 may include a reset period T11, a threshold compensation period T12, and a data writing period T13.

In the non-light emitting period T10, since EM1=0, the first transistor M1 is turned on, to provide the first power signal ELVDD to the second electrode of the light emitting component L, so that the voltage of the second electrode of the light emitting component L is $V_{dd}$. Since EM2=1, the second transistor M2 is turned off.

In the reset period T11, since GA=0, the third transistor M3 is turned on. Furthermore, since RES=0, the fourth transistor M4 is turned on. The process of this period can refer to the reset period T11 in the embodiment of the pixel compensation circuit shown in FIG. 2, which is not described in detail here.

In the threshold compensation period T12, since GA=0, the third transistor M3 is turned on. Furthermore, since RES=1, the fourth transistor M4 is turned off. The process of this period can be seen in the threshold compensation period T12 in the embodiment of the pixel compensation circuit shown in FIG. 2, which is not described in detail here.

In the data writing period T13, since RES=1, the fourth transistor M4 is turned off. Since GA=0, the third transistor M3 is turned on. The process of this period can refer to the data writing period T13 in the embodiment of the pixel compensation circuit shown in FIG. 2, which is not described in detail here.

In the light emitting period T20, since EM1=1, the first transistor M1 is turned off. Since RES=1, the fourth transistor M4 is turned off. Since GA=1, the third transistor M3 is turned off. Since EM2=0, the second transistor M2 is turned on, to provide the second power signal ELVSS to the second electrode of the light emitting component L, so that the voltage of the second electrode of the light emitting component L is $V_{ss}$. The process of this period can refer to the light emitting period T20 in the embodiment of the pixel compensation circuit shown in FIG. 2, which is not described in detail here.

Figure 6:
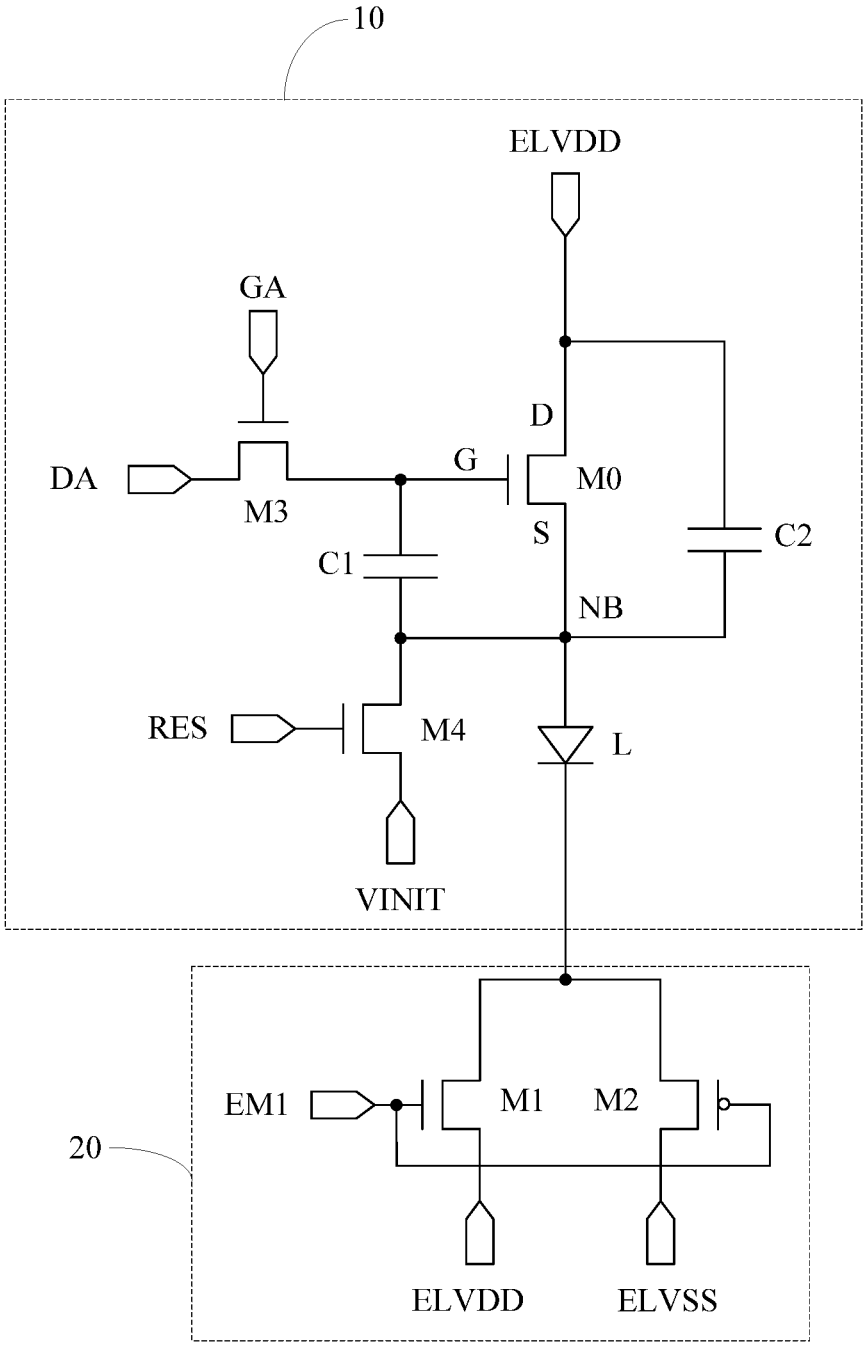
FIG. 6 is a third schematic detailed structural diagram of a pixel compensation circuit in accordance with an embodiment of the present disclosure.

The embodiments of the present disclosure provide still other pixel compensation circuits, as shown in FIG. 6, which are modified to the embodiment shown in FIG. 2. Next, only the differences between the present embodiment and the embodiment of the pixel compensation circuit shown in FIG. 2 will be explained, and the similarities will not be repeated here.

Figure 7:
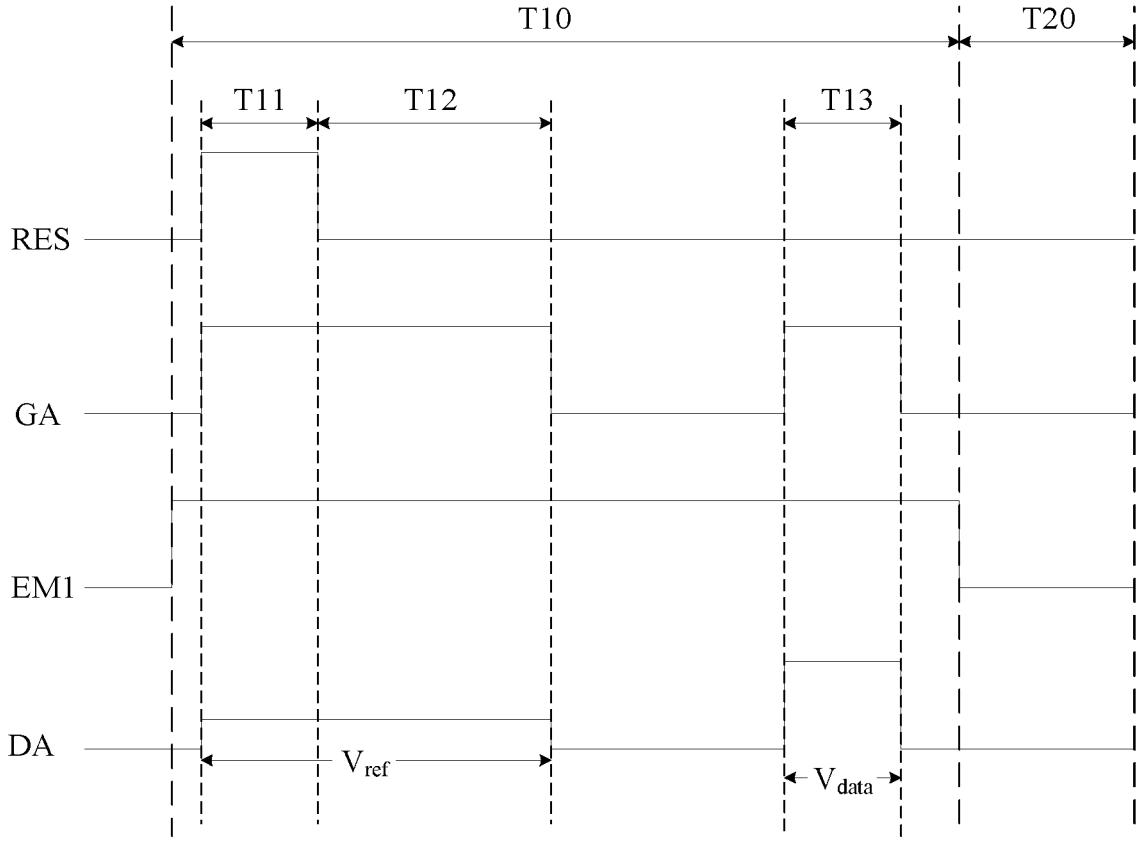
FIG. 7 is a third signal timing diagram in accordance with an embodiment of the present disclosure.

In implementation, in the embodiments of the present disclosure, as shown in FIG. 6, a first light emission control signal and a second light emission control signal are the same signal, and the transistor types of a first transistor M1 and a second transistor M2 are different. For example, as shown in FIG. 6, the first transistor M1 is an N-type transistor and the second transistor M2 is a P-type transistor, and a gate of the first transistor M1 and a gate of the second transistor M2 both receive the first light emission control signal EM1 to simultaneously control the gate of the first transistor M1 and the second transistor M2 through the first light emission control signal EM1. The first light emission control signal EM1 is shown in FIG. 7. Of course, the gate of the first transistor M1 and the gate of the second transistor M2 may both receive the second light emission control signal EM2, which is not limited here.

Taking the pixel compensation circuit shown in FIG. 6 as an example, the operation process of the pixel compensation circuit according to the embodiments of the present disclosure will be described below in conjunction with the signal timing diagram shown in FIG. 7. In the following description, a high-level signal is denoted by 1 and a low-level signal is denoted by 0. It should be noted that 1 and 0 are logic levels, which are only for better explanation of the operation process of the embodiments of the present disclosure, rather than the voltage applied to the gates of the transistors during implementation.

One frame time may include a non-light emitting period T10 and a light emitting period T20. The non-light emitting period T10 may include a reset period T11, a threshold compensation period T12, and a data writing period T13.

In the non-light emitting period T10, since EM1=1, the first transistor M1 is turned on and the second transistor M2 is turned off.

In the reset period T11, since GA=1, the third transistor M3 is turned on. Furthermore, since RES=1, the fourth transistor M4 is turned on. The process of this period can refer to the reset period T11 in the embodiment of the pixel compensation circuit shown in FIG. 2, which is not described in detail here.

In the threshold compensation period T12, since GA=1, the third transistor M3 is turned on. Furthermore, since RES=0, the fourth transistor M4 is turned off. The process of this period can refer to the threshold compensation period T12 in the embodiment of the pixel compensation circuit shown in FIG. 2, which is not described in detail here.

In the data writing period T13, since RES=0, the fourth transistor M4 is turned off. Since GA=1, the third transistor M3 is turned on. The process of this period can refer to the data writing period T13 in the embodiment of the pixel compensation circuit shown in FIG. 2, which is not described in detail here.

In the light emitting period T20, since EM1=, the first transistor M1 is turned off and the second transistor M2 is turned on. Since RES=0, the fourth transistor M4 is turned off. Since GA=0, the third transistor M3 is turned off. The process of this period can refer to the light emitting period T20 in the embodiment of the pixel compensation circuit shown in FIG. 2, which is not described in detail here.

Figure 8:
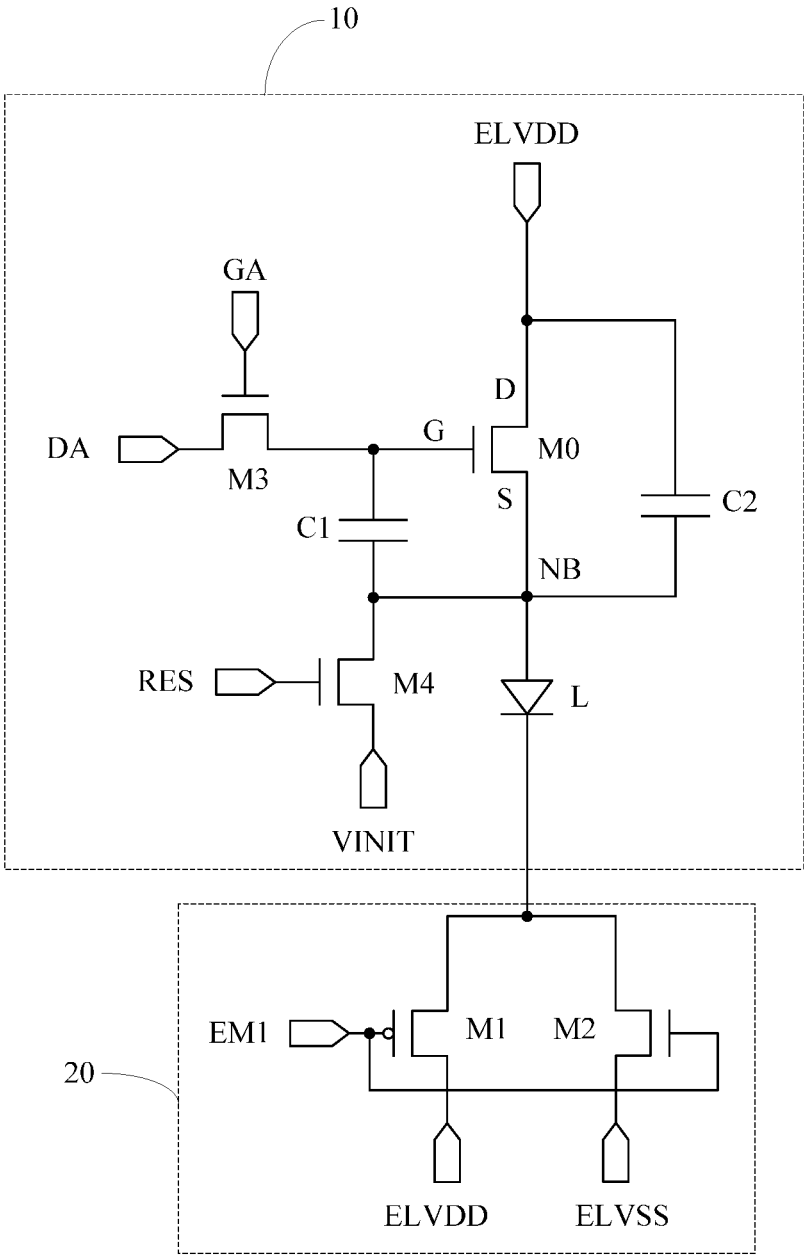
FIG. 8 is a fourth schematic detailed structural diagram of a pixel compensation circuit in accordance with an embodiment of the present disclosure.

The embodiments of the present disclosure provide still other pixel compensation circuits, as shown in FIG. 8, which are modified to the embodiment shown in FIG. 2. Next, only the differences between the present embodiment and the embodiment of the pixel compensation circuit shown in FIG. 2 will be explained, and the similarities will not be repeated here.

Figure 9:
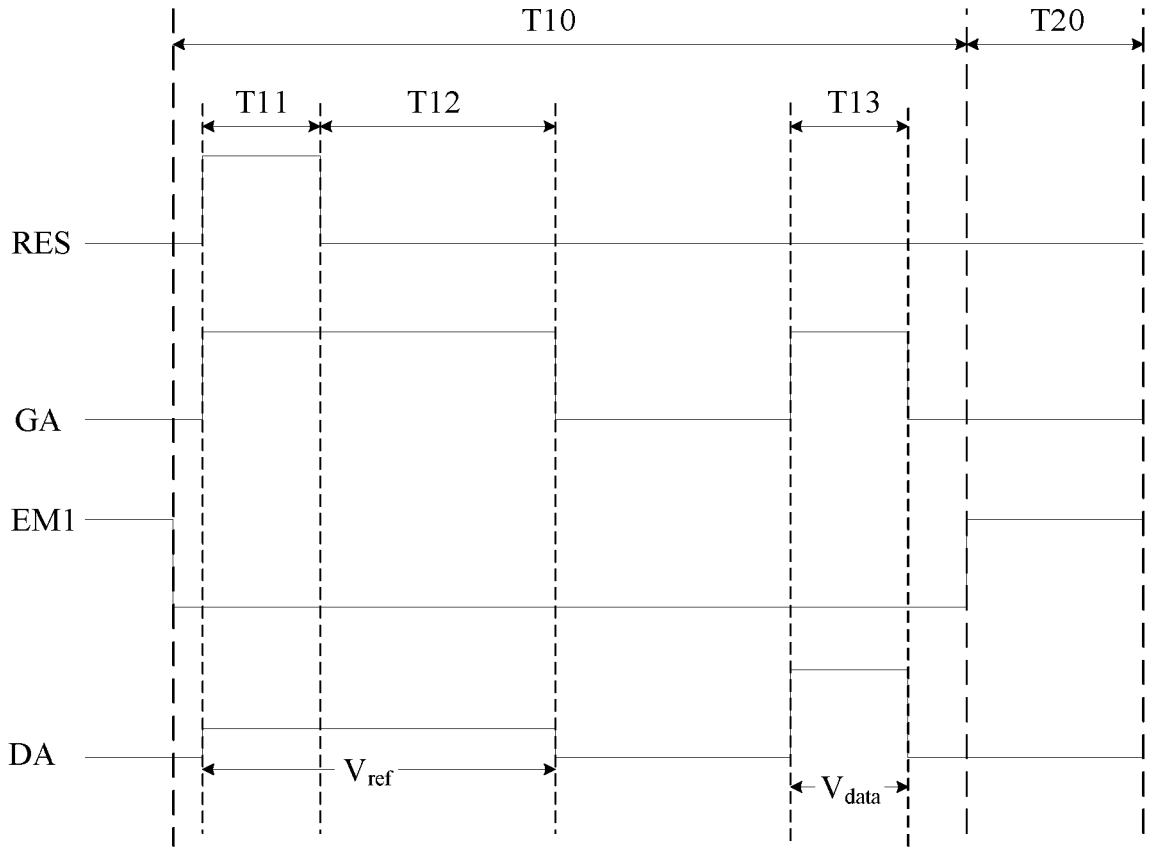
FIG. 9 is a fourth signal timing diagram in accordance with an embodiment of the present disclosure.

In implementation, in the embodiments of the present disclosure, as shown in FIG. 8, a first light emission control signal and a second light emission control signal are the same signal, and the transistor types of a first transistor M1 and a second transistor M2 are different. For example, as shown in FIG. 8, the first transistor M1 is a P-type transistor and the second transistor M2 is an N-type transistor, and a gate of the first transistor M1 and a gate of the second transistor M2 both receive the first light emission control signal EM1 to simultaneously control the gate of the first transistor M1 and the second transistor M2 through the first light emission control signal EM1. The first light emission control signal EM1 is shown in FIG. 9. Of course, the gate of the first transistor M1 and the gate of the second transistor M2 may both receive the second light emission control signal EM2, which is not limited here.

Taking the pixel compensation circuit shown in FIG. 8 as an example, the operation process of the pixel compensation circuit according to the embodiments of the present disclosure will be described below in conjunction with the signal timing diagram shown in FIG. 9. In the following description, a high-level signal is denoted by 1 and a low-level signal is denoted by 0. It should be noted that 1 and 0 are logic levels, which are only for better explanation of the operation process of the embodiments of the present disclosure, rather than the voltage applied to the gates of the transistors during implementation.

One frame time may include a non-light emitting period T10 and a light emitting period T20. The non-light emitting period T10 may include a reset period T11, a threshold compensation period T12, and a data writing period T13.

In the non-light emitting stage T10, since EM1=0, the first transistor M1 is always on and the second transistor M2 is always off.

In the reset period T11, since GA=1, the third transistor M3 is turned on. Furthermore, since RES=1, the fourth transistor M4 is turned on. The process of this period can refer to the reset period T11 in the embodiment of the pixel compensation circuit shown in FIG. 2, which is not described in detail here.

In the threshold compensation period T12, since GA=1, the third transistor M3 is turned on. Furthermore, since RES=0, the fourth transistor M4 is turned off. The process of this period can refer to the threshold compensation period T12 in the embodiment of the pixel compensation circuit shown in FIG. 2, which is not described in detail here.

In the data writing period T13, since RES=0, the fourth transistor M4 is turned off. Since GA=1, the third transistor M3 is turned on. The process of this period can refer to the data writing period T13 in the embodiment of the pixel compensation circuit shown in FIG. 2, which is not described in detail here.

In the light emitting period T20, since EM0=0, the first transistor M1 is turned off and the second transistor M2 is turned on. Since RES=0, the fourth transistor M4 is turned off. Since GA=0, the third transistor M3 is turned off. The process of this period can refer to the light emitting period T20 in the embodiment of the pixel compensation circuit shown in FIG. 2, which is not described in detail here.

Figure 10:
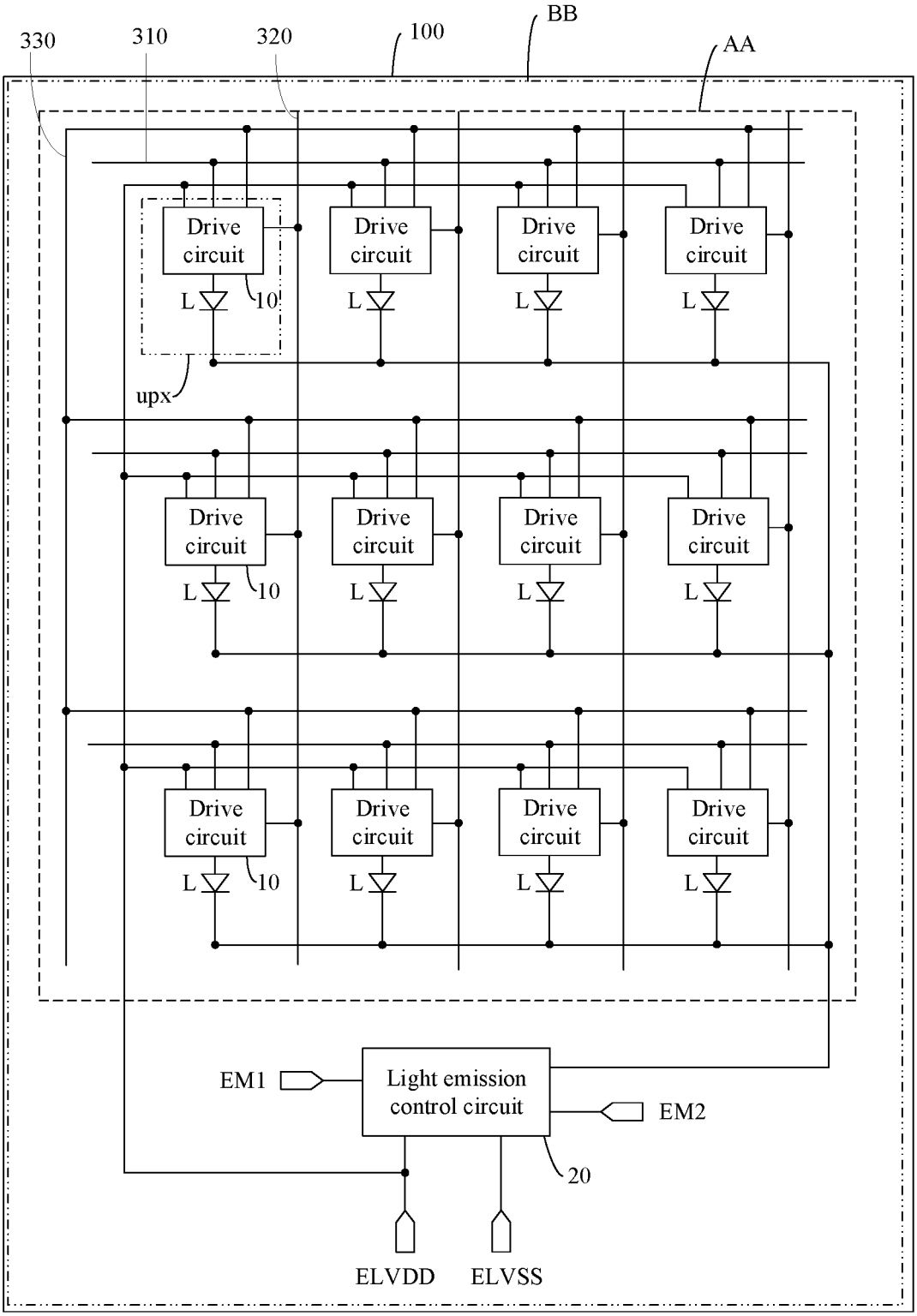
FIG. 10 is a first schematic structural diagram of a display panel in accordance with an embodiment of the present disclosure.

Based on the same inventive concept, the embodiments of the present disclosure also provide a display panel. As shown in FIG. 10, the display panel may include a base substrate 100 and any of the above pixel compensation circuits according to the embodiments of the present disclosure. The base substrate 100 includes a display area AA and a non-display area surrounding the display area AA. The drive circuits 10 and the light emitting components L in the pixel compensation circuits are located in the display area AA of the base substrate 100. According to the display panel according to the embodiments of the present disclosure, by adopting the pixel compensation circuits, the display panel does not emit light in the threshold compensation period and the data writing period so that afterimages can be avoided.

Generally, the display area of the display panel may include a plurality of pixel units, and each pixel unit may include a plurality of subpixels. For example, the pixel units may include red subpixels, green subpixels, and blue subpixels so that the display panel can display a picture using the principle of red, green, and blue color mixing. Of course, in actual application, the subpixels in the pixel units can be designed and determined according to the actual application environment, which is not limited here.

In implementation, as shown in FIG. 10, each subpixel upx is provided with a drive circuit 10 and a light emitting component L, so that the change to the display area is small, even no change. In the embodiments of the present disclosure, all the pixel compensation circuits may share one light emission control circuit 20. That is, only one light emission control circuit 20 is provided in the display panel, and the second electrodes of all the light emitting components L in the display area AA are electrically connected to the same light emission control circuit 20. For example, as shown in FIG. 10, the light emission control circuit 20 together with the light emitting component L and the drive circuit 10 in one subpixel upx may form a pixel compensation circuit, the light emission control circuit 20 together with the light emitting component L and the drive circuit 10 in another subpixel upx may form another pixel compensation circuit, and so on, which will not be listed here. In this way, the arrangement of transistors and signal lines may be reduced, which is beneficial to pixel wiring and resolution improvement.

In implementation, in the embodiments of the present disclosure, as shown in FIG. 10, the display panel may further include a plurality of gate lines 310, a plurality of data lines 320, and a reset signal line 330. Subpixels in a row of pixel units correspond to one gate line 310, and a column of subpixels correspond to one data line 320. Referring to FIGS. 2 and 10, the gate lines 310 are electrically connected to the gates of the third transistors M3 of the drive circuits 10 in the corresponding pixel units, so that the corresponding timing signals are transmitted to the scanning signal terminals GA through the gate lines 310. The data lines 320 are electrically connected to the first electrodes of the third transistors M3 of the drive circuits 10 in the corresponding pixel units, so that corresponding signals are transmitted to the data signal terminals DA through the data lines 320. The gates of the fourth transistors M4 of the drive circuits 10 are electrically connected to the reset signal lines 330. Further, the gates of the fourth transistors M4 of all the drive circuits 10 in the display area AA are electrically connected to the same reset signal line 330, that is, the signals transmitted to the reset signal terminals RES electrically connected to the gates of all the fourth transistors M4 in the display area AA are the same. Of course, the display area may also include a first power signal line and an initialization signal line. Specifically, the first power signal line is of a grid structure, and the first electrodes D of the drive transistors M0 in drive circuits 10 are electrically connected to the first power signal line, so as to transmit the first power signal ELVDD through the first power signal line. The first electrodes of the fourth transistors M4 in the drive circuits 10 are electrically connected to the initialization signal line, so as to transmit the initialization signals of the voltage Vinit through the initialization signal line.

Generally, the base substrate is provided with a non-display area surrounding the display area. In implementation, in the embodiments of the present disclosure, as shown in FIG. 10, the non-display area BB is around the display area AA, and the light emission control circuit 20 can be located in the non-display area of the base substrate 100. The non-display area is an area other than the display area AA of the base substrate 100. In this way, the transistors in the light emission control circuit 20 and the transistors in the display area AA can be prepared at the same time so that the process preparation difficulty can be reduced.

Figure 11:
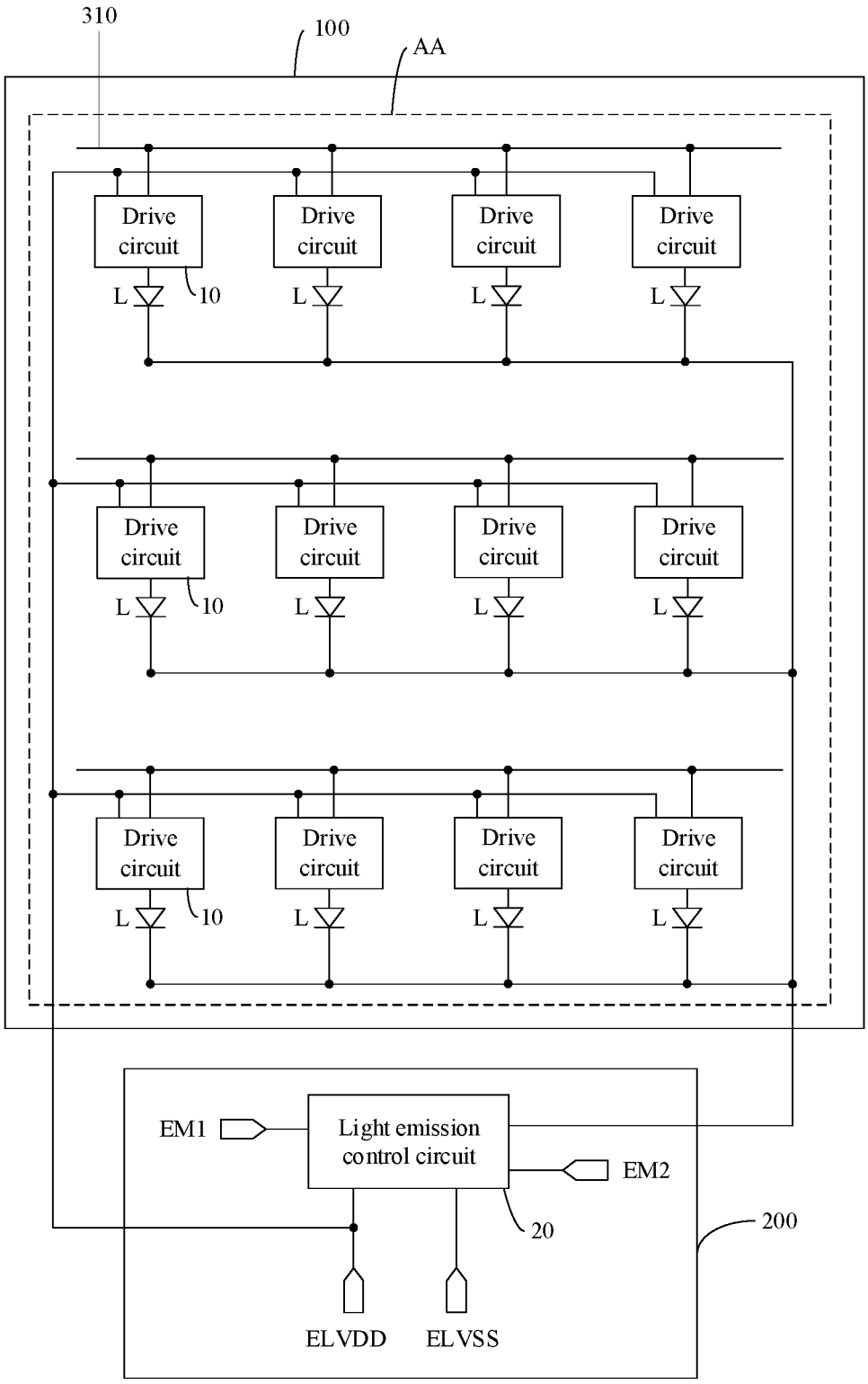
FIG. 11 is a second schematic structural diagram of a display panel in accordance with an embodiment of the present disclosure.

Generally, in order to provide signals to the display area AA, in implementation, the display panel may further include at least one of a driving chip, a flexible printed circuit (FPC), and a printed circuit board (PCB). The driving chip may be an integrated circuit (IC). The light emission control circuit may be in at least one of the driving chip, the flexible printed circuit, and the printed circuit board. For example, as shown in FIG. 11, the light emission control circuit 20 may be arranged in the printed circuit board 200. It should be noted that FIG. 11 only illustrates the case where the light emission control circuit 20 is arranged in the printed circuit board 200, and the case where the light emission control circuit 20 is arranged in the driving chip and the case where the light emission control circuit 20 is arranged in the flexible printed circuit may also refer to the arrangement shown in FIG. 11, which is not described in detail here.

Figure 12:
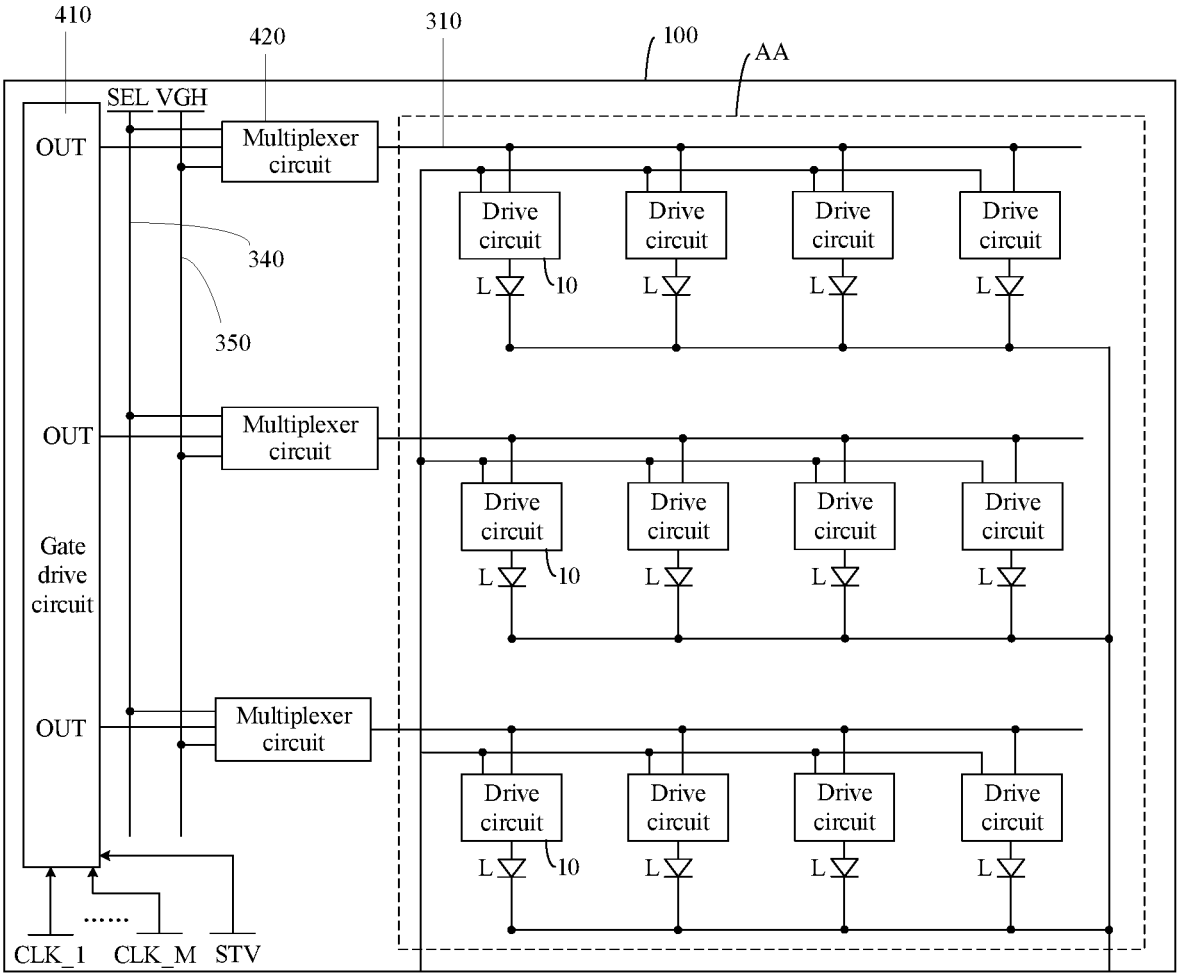
FIG. 12 is a third schematic structural diagram of a display panel in accordance with an embodiment of the present disclosure.

In implementation, in the embodiments of the present disclosure, as shown in FIG. 12, the display panel may further include a gate drive circuit 410 and multiplexer circuits 420 one-to-one corresponding to the gate lines 310. Each gate line 310 is coupled to a signal output terminal OUT of the gate drive circuit 410 through the corresponding multiplexer circuit 420. The multiplexer circuit 420 is configured to connect a fixed voltage signal terminal VGH to the corresponding gate line 310 in response to a conduction control signal SEL having a first level, and connect the signal output terminal OUT to the corresponding gate line 310 in response to a conduction control signal SEL having a second level. Specifically, the first level may be a high level and the second level may be a low level. Alternatively, the first level may be a low level and the second level may be a high level, which is not limited here.

Figure 13:
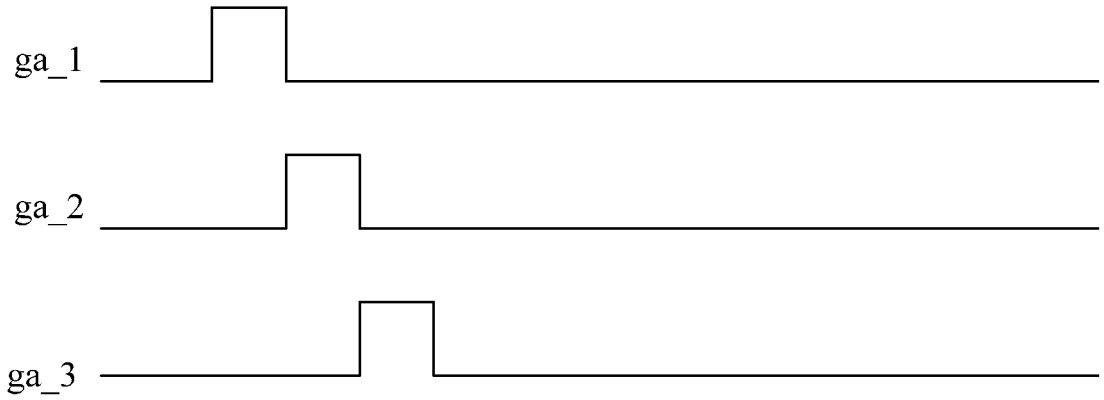
FIG. 13 is a schematic diagram of a scanning signal in accordance with an embodiment of the present disclosure.

In implementation, in the embodiments of the present disclosure, the gate drive circuit 410 may output scan signals to the gate lines row by row under the control of the input frame trigger signal STV and clock signals CLK_1~CLK_M (M is the total number of clock signals, and the value of M may be designed and determined according to the actual application environment, which is not limited here). For example, as shown in FIG. 13, taking the gate lines 310 corresponding to the first row of pixel units to the third row of pixel units as an example, the gate drive circuit 410 may output the scanning signal ga_1 to the gate line 310 corresponding to the first row of pixel units, the scanning signal ga_2 to the gate line 310 corresponding to the second row of pixel units, the scanning signal ga_3 to the gate line 310 corresponding to the third row of pixel units, and so on, which will not be listed here.

In implementation, in the embodiments of the present disclosure, the structures and working principles of the gate drive circuit and the multiplexer circuits can be basically the same as those in the related art, and will not be described here.

In implementation, the conduction control signals received by multiplexer circuits can be the same signal. As shown in FIG. 12, in this way, all the multiplexer circuits 420 can be electrically connected to the same conduction control signal line 340, so that conduction control signal line 340 can transmit the conduction control signal SEL to each multiplexer circuit 420.

In implementation, as shown in FIG. 12, all the multiplexer circuits 420 may be electrically connected to the same fixed voltage signal line 350, so that the fixed voltage signal line 350 can transmit the fixed voltage signal VGH to each multiplexer circuit 420.

In implementation, the frame trigger signal STV, the clock signals CLK_1~CLK_M, the fixed voltage signal VGH, the conduction control signal SEL, the reset signal RE, the first power signal ELVDD, and the initialization signal may be provided by other circuits on the PCB or the drive IC, which is not limited here.

Figure 14:
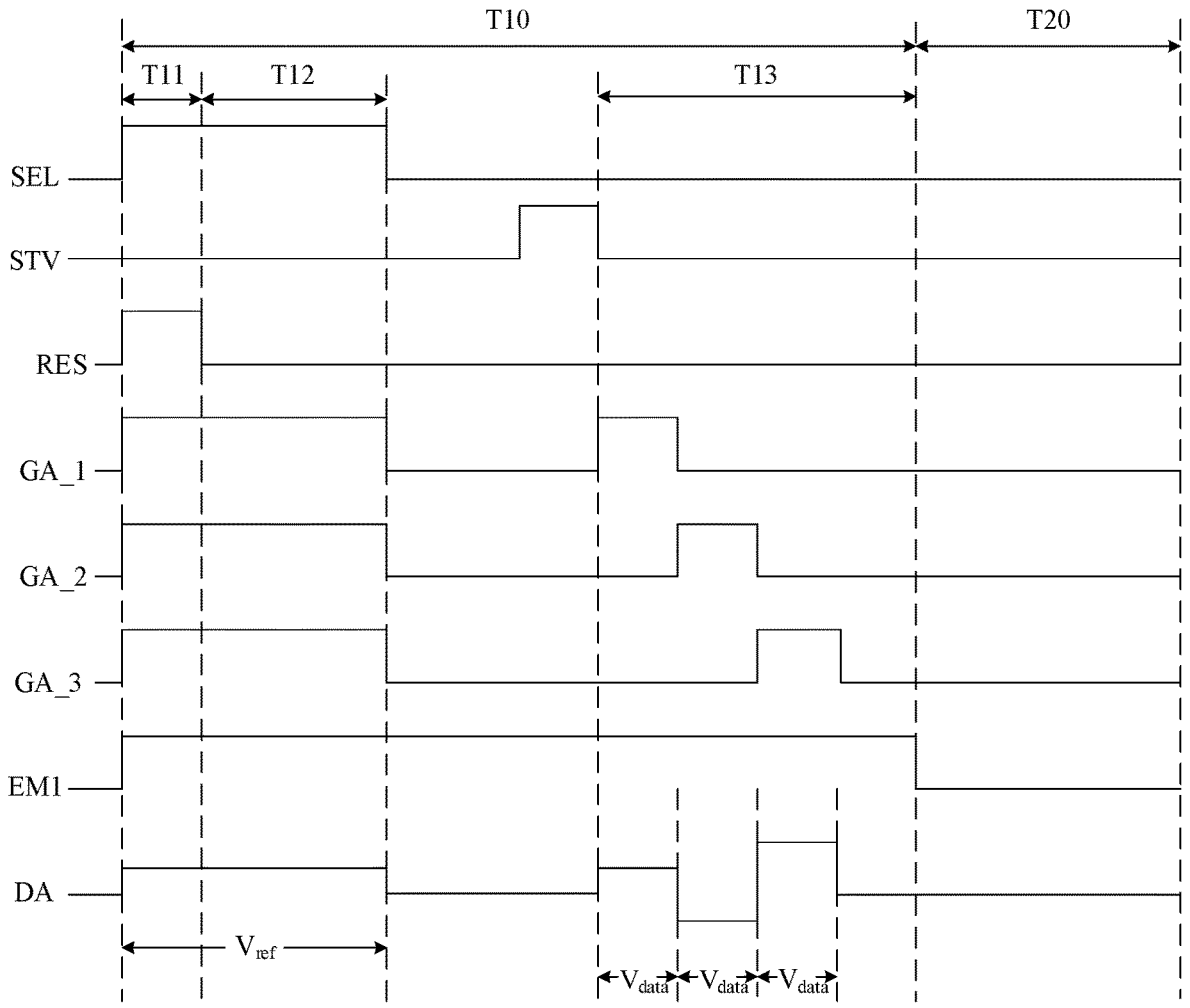
FIG. 14 is a fifth signal timing diagram in accordance with an embodiment of the present disclosure.

Taking FIG. 6, FIG. 10, FIG. 12, and the gate lines 310 corresponding to the first row of pixel units to the third row of pixel units as an example, and referring to the signal timing diagram shown in FIG. 14, the operation of the display panel according to the present disclosure will be described below. However, readers should know that the specific process is not limited thereto.

One frame time may include a non-light emitting period T10 and a light emitting period T20. The non-light emitting period T10 may include a reset period T11, a threshold compensation period T12, and a data writing period T13.

In the non-light emitting period T10, since EM1=1, the first transistor M1 is turned on so as to provide the first power signal ELVDD to the second electrode of each light emitting component L, so that the voltage of the second electrode of each light emitting component L is $V_{dd}$. Moreover, since EM1=1, the second transistor M2 is turned off.

In the reset period T11, since SEL=1, the signal output terminals OUT of the gate drive circuit 410 are disconnected from the gate lines 310, while the fixed voltage signal terminal VGH is connected to each gate line 310, so that the signal on each gate line 310 is a high level signal, such as the signal GA_1 transmitted from the first row of gate line 310 to the scanning signal terminal GA, the signal GA_2 transmitted from the second row of gate line 310 to the scanning signal terminal GA, and the signal GA_3 transmitted from the third row of gate line 310 to the scanning signal terminal GA. Since GA_1=1~GA_3=1, all the third transistors M3 in the display area AA can be turned on simultaneously, to provide the reference voltage signal input from the data signal terminal DA to the gates G of the drive transistors M0, so that the voltage of the gate G of each drive transistor M0 is the voltage $V_{ref}$ of the reference voltage signal. Since RES=1, all the fourth transistors M4 in the display area AA are turned on, to provide the initialization signal input from the initialization signal terminal VINIT to the first electrodes of the light emitting components L, so that the voltage of the first electrode of each light emitting component L is the voltage $V_{init}$ of the initialization signal.

In the threshold compensation period T12, since RES=0, all the fourth transistors M4 in the display area AA are turned off. Since SEL=1, the fixed voltage signal terminal VGH is connected to each gate line 310, so that the signal on each gate line 310 is a high level signal, such as the signal GA_1 transmitted from the first row of gate line 310 to the scanning signal terminal GA, the signal GA_2 transmitted from the second row of gate line 310 to the scanning signal terminal GA, and the signal GA_3 transmitted from the third row of gate line 310 to the scanning signal terminal GA. Since GA_1=1~GA_3=1, all the third transistors M3 in the display area AA can be turned on simultaneously, to provide the reference voltage signal input from the data signal terminal DA to the gates G of the drive transistors M0, so that the voltage of the gate G of each drive transistor M0 is the voltage $V_{ref}$ of the reference voltage signal. At the moment when the fourth transistors M4 are turned off, the voltage difference across each first capacitor C1 can still be kept at $V_{ref}-V_{init}$. Since $V_{ref}>V_{init}+V_{th}$, each drive transistor M0 can be turned on to generate a current flowing from the first electrode D to the second electrode S, so as to charge the first capacitor C1 and the second capacitor C2 by the current, thus making the voltages of the second terminal of the first capacitor C1 and the second terminal of the second capacitor C2 (i.e., the voltage at the point NB) gradually rise. When the voltage $V_{NB1}$ at the point NB rises to $V_{ref}-V_{th}$, each drive transistor M0 is turned off. Moreover, the charge $Q_{NBT12}$ at each NB point can satisfy the formula: $Q_{NBT12}=c2(V_{NB1}-V_{dd})+c1(V_{NB1}-V_{ref})+cL(V_{NB1}-V_{dd})=(c2+cL)(V_{ref}-V_{th}-V_{dd})-c1V_{th}$.

In the data writing period T13, since RES=0, all the fourth transistors M4 in the display area AA are turned off. Since SEL=0, the fixed voltage signal terminal VGH is disconnected from each gate line 310, and the signal output terminals OUT of the gate drive circuit 410 are connected to the gate lines 310 to enable the gate drive circuit 410 to output scanning signals to the gate lines, including the signal GA_1 transmitted from the first row of gate line 310 to the scanning signal terminal GA, the signal GA_2 transmitted from the second row of gate line 310 to the scanning signal terminal GA, and the signal GA_3 transmitted from the third row of gate line 310 to the scanning signal terminal GA, so as to control the third transistors to be turned on row by row.

Specifically, since GA_1=1, the third transistors M3 in first row of the subpixels are turned on to provide the data signal input from the data signal terminal DA to the gates G of the drive transistors M0 and charge the first capacitors C1 and the second capacitors C2. After balancing, the voltage of the gate G of each drive transistor M0 is the voltage $V_{DA}$ of the data signal, and the voltage at the point NB is $V_{NB2}$. Then at this point, the charge $Q_{NBT13}$ at the point NB can satisfy the formula: $Q_{NBT12}=(c2+cL)(V_{NB2}-V_{dd})-c1(V_{data}-V_{NB2})$. In the process of data signal input, the point NB has neither charge inflow nor charge outflow, so the charge at the point NB in the period T13 is: $Q_{NBT13}=Q_{NBT12}$. Therefore, $$V_{NB2}=\frac{c1^{*}V_{data}+(c2+cL)V_{ref}}{c1+c2+cL}-V_{th}.$$

Since GA_2=0, the third transistors M3 in the second row of the subpixels are turned off, since GA_3=0, the third transistors M3 in the third row of subpixels are turned off; and so on, which will not be listed here.

Since GA_2=1, the third transistors M3 in the second row of subpixels are turned on to provide the data signal input from the data signal terminal DA to the gates G of the drive transistors M0 and charge the first capacitors C1 and the second capacitors C2. After balancing, the voltage of the gate G of each drive transistor M0 is the voltage $V_{DA}$ of the data signal, and the voltage at the point NB is $V_{NB2}$. Then at this point, the charge $Q_{NBT13}$ at the point NB can satisfy the formula: $Q_{NBT12}=(c2+cL)(V_{NB2}-V_{dd})-c1(V_{data}-V_{NB2})$. In the process of data signal input, the point NB has neither charge inflow nor charge outflow, so the charge at the point NB in the period T13 is: $Q_{NBT13}=Q_{NBT12}$. Therefore, $$V_{NB2}=\frac{c1^{*}V_{data}+(c2+cL)V_{ref}}{c1+c2+cL}-V_{th}.$$

Since GA_1=0, the third transistors M3 in the first row of the subpixels are turned off, since GA_3=0, the third transistors M3 in the third row of the subpixels are turned off; and so on, which will not be listed here.

Since GA_3=1, the third transistors M3 in the third row of the subpixels are turned on, to provide the data signal input from the data signal terminal DA to the gates G of the drive transistors M0 and charge the first capacitors C1 and the second capacitors C2. After balancing, the voltage of the gate G of each drive transistor M0 is the voltage $V_{DA}$ of the data signal, and the voltage at the point NB is $V_{NB2}$. Then at this point, the charge $Q_{NBT13}$ at the point NB can satisfy the formula: $Q_{NBT12}=(c2+cL)(V_{NB2}-V_{dd})-c1(V_{data}-V_{NB2})$. In the process of data signal input, the point NB has neither charge inflow nor charge outflow, so the charge at the point NB in the period T13 is: $Q_{NBT13}=Q_{NBT12}$. Therefore, $$V_{NB2}=\frac{c1^{*}V_{data}+(c2+cL)V_{ref}}{c1+c2+cL}-V_{th}.$$

Since GA_1=0, the third transistors M3 in the first row of the subpixels are turned off, since GA_2=0, the third transistors M3 in the second row of the subpixels are turned off; and so on, which will not be listed here.

In the light emitting period T20, since SEL=0, the signal output terminals OUT of the gate drive circuit 410 are connected to the gate lines 310, so that the gate drive circuit 410 outputs scanning signals to the gate lines, including the signal GA_1 transmitted from the first row of gate line 310 to the scanning signal terminal GA, the signal GA_2 transmitted from the second row of gate line 310 to the scanning signal terminal GA, and the signal GA_3 transmitted from the third row of gate line 310 to the scanning signal terminal GA, so as to control the third transistors to be turned off. Since EM1=0, the first transistors M1 are turned off and the second transistors M2 are turned on. Since RES=0, the fourth transistors M4 are turned off. The turned-on second transistors M2 provide the second power signals ELVSS to the second electrode of each light emitting component L, so that the voltage of the second electrode of each light emitting component L is $V_{ss}$. Each drive transistor M0 generates the drive current $I_L$ under the control of the voltage $V_{NB2}$ of its second electrode S and the voltage $V_{DA}$ of its gate G, $$I_L=K(V_{data}-V_{NB2}-V_{th})^2=K\left(\frac{cL+c2}{cL+c1+c2}\right)^2(V_{data}-V_{ref})^2,$$

so as to drive the light emitting components L to emit light by the drive current $I_L$.

As can be seen from the above embodiments, for the display panel according to the embodiments of the present disclosure, the display panel is controlled to be in the non-display period T10 through the first transistors M1 and in the display period T20 through the second transistors M2, so that the display panel can be made in the non-display period completely through a simple pixel compensation circuit structure, thereby avoiding afterimages in the non-display period and improving the display effect.

Furthermore, in the reset period T11, the third transistors M3 in the display panel are turned on simultaneously, $V_{ref}$ can be simultaneously written to the gate G of each drive transistor M0. By turning on the fourth transistors M4 in the display panel at the same time, $V_{init}$ can be written to the second electrode S of each drive transistor M0 at the same time, and the first electrodes of the light emitting components L can be reset at the same time. This can reduce the number of the gate lines.

In addition, at present, threshold compensation is generally performed through $V_{th}$ writing row by row, so that the time for compensating for $V_{th}$ is only the time for one row of pixels to be turned on, which results in short $V_{th}$ compensating time and low charging rate. However, for the display panel according to the embodiments of the present disclosure, in the threshold compensation period T12, $V_{th}$ of each drive transistor M0 is simultaneously written to its gate G by turning on each third transistor M3 in the display panel simultaneously, and then in the data writing period T13, the data signal is written to each drive transistor M0 row by row. In this way, compared with row-by-row writing of $V_{th}$, the writing time of $V_{th}$ can be made long enough to improve the charging rate of $V_{th}$ writing, so as to solve the problem of insufficient $V_{th}$ writing at a high refresh rate. In addition, only data lines can be used to transmit both reference voltage signals and data signals, thus reducing the number of the signal lines.

In addition, the duration $t_{13}$ of the data writing period T13 can meet the following formula: $t_{13} \leq t_F - (t_{11} + t_{12} + t_{20})$, wherein $t_F$ represents the duration of one frame time, $t_{11}$ represents the duration of the reset period T11 within one frame time, $t_{12}$ represents the duration of the threshold compensation period T12 within one frame time, and $t_{20}$ represents the duration of the light emitting period T20 within one frame time. The duration for scanning one row of pixel units is $t_{13}/K$, wherein K represents the total number of the gate lines. Further, $t_{13}$ may be k multiplied by $t_{13}/K$, where k may be a positive integer, e.g., k is one of 1 to 50. Moreover, the brightness of the light emitting components can also be set by $t_{20}/t_F$. Of course, in actual application, the specific values of K and the above duration can be designed and determined according to the actual application environment, which is not limited here.

Figure 15:
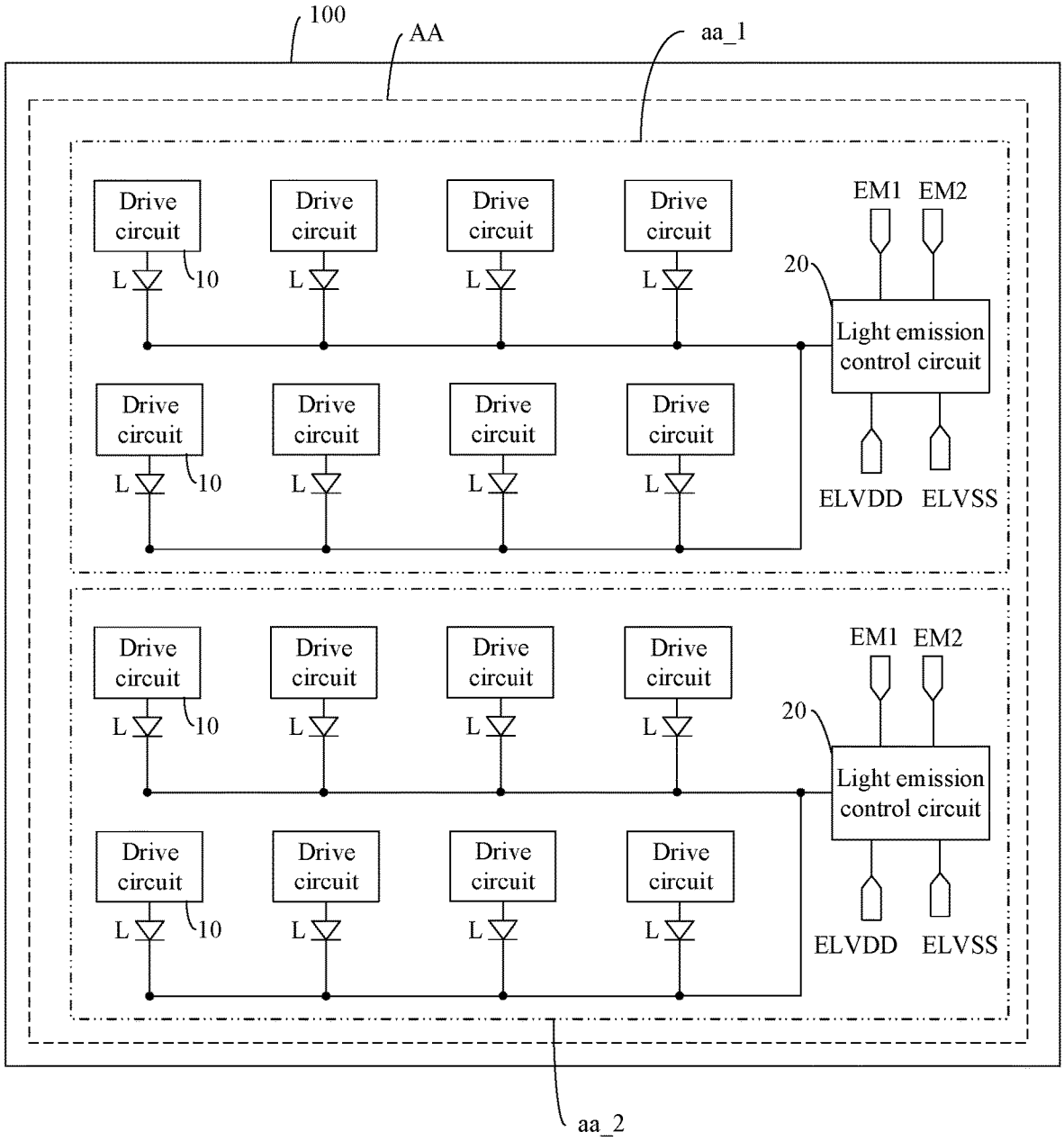
FIG. 15 is a fourth schematic structural diagram of a display panel in accordance with an embodiment of the present disclosure.
Figure 16:
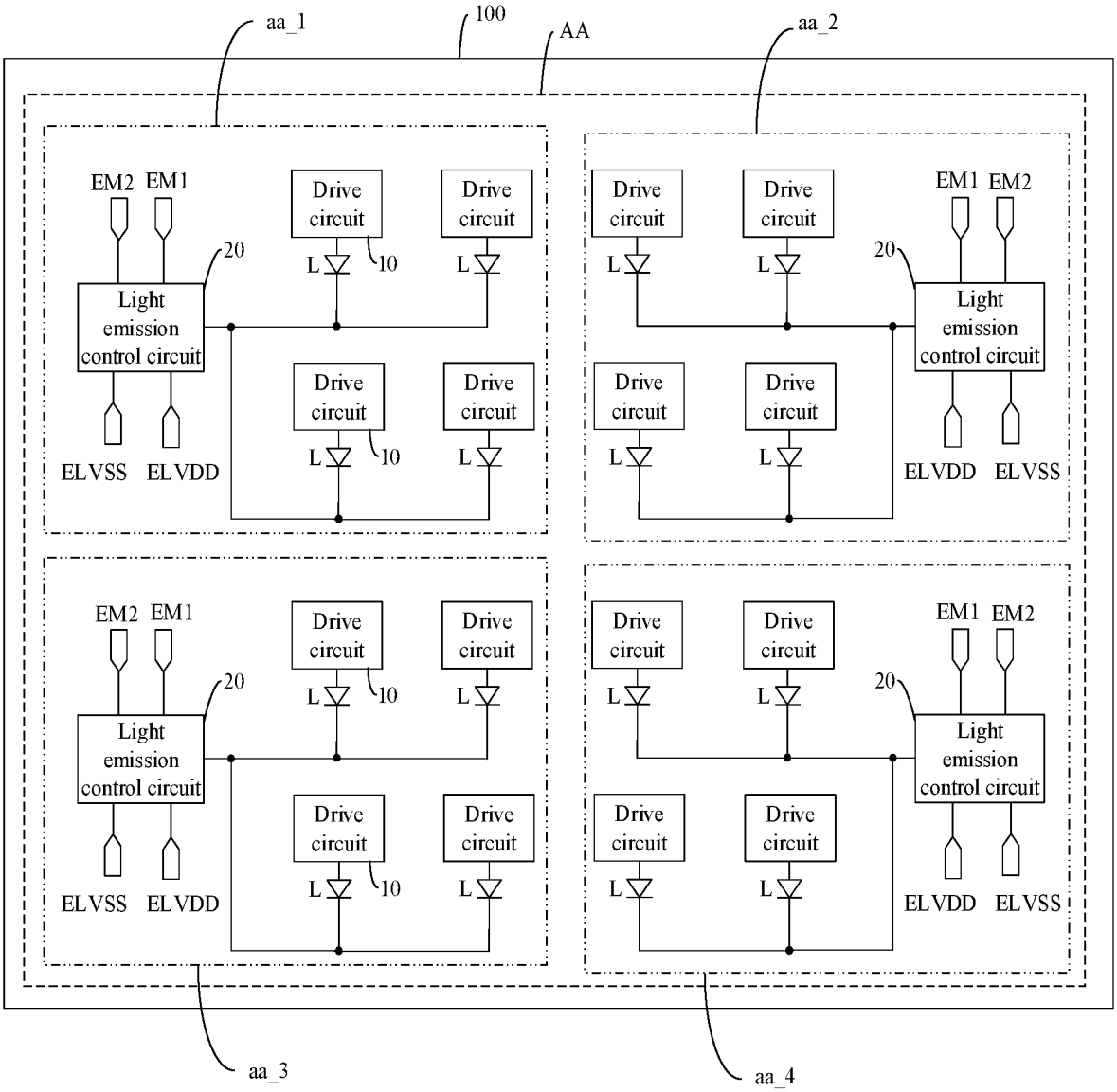
FIG. 16 is a fifth schematic structural diagram of a display panel in accordance with an embodiment of the present disclosure.

The embodiments of the present disclosure provide other display panels, as shown in FIGS. 15 and 16, which are modified to the embodiment shown in FIG. 10. Next, only the differences between the present embodiment and the embodiment of the display panel shown in FIG. 10 will be explained, and the similarities will not be repeated here.

In implementation, in the embodiments of the present disclosure, as shown in FIGS. 15 and 16, the display area AA may include a plurality of sub-display areas aa_y (y is an integer greater than 1 and less than or equal to Y, Y is the total number of the sub-display areas, Y=2 in FIG. 15, and Y=4 in FIG. 16). All the light emitting components L in each sub-display area aa_y can be coupled to the same light emission control circuit 20 to perform regional control. This can also reduce the driving difficulty of the light emission control circuit 20.

In implementation, in the embodiments of the present disclosure, each sub-display area may include a plurality of pixel units. Alternatively, each sub-display area may include only one subpixel. In actual application, the implementation mode of the sub-display areas can be designed and determined according to the actual application environment, which is not limited here.

In implementation, in the embodiments of the present disclosure, as shown in FIGS. 15 and 16, each sub-display area aa_y corresponds to one light emission control circuit 20, and the light emission control circuits 20 can be located in the corresponding sub-display areas aa_y on the base substrate 100. This allows each light emission control circuit to be closer to the corresponding light emitting components L. Alternatively, the light emission control circuits 20 may be located in the non-display area. For example, the light emission control circuits 20 are located in the non-display area of the base substrate 100 around the display area AA. Alternatively, the light emission control circuits 20 are located in at least one of the driving chip, the flexible printed circuit and the printed circuit board. Of course, this can be designed and determined according to the actual application environment and is not limited here.

In implementation, in the embodiments of the present disclosure, each sub-display area may extend along a first direction and the sub-display areas may be arranged along a second direction, wherein the first direction and the second direction intersect. Specifically, as shown in FIG. 15, the first direction may be the row direction of the pixel units, the second direction may be the column direction of the pixel units, each sub-display area aa_y extends along the row direction of the pixel units, and the sub-display areas aa_y are arranged along the column direction of the pixel units. Alternatively, the first direction may be the column direction of the pixel units, the second direction may be the row direction of the pixel units, each sub-display area extends along the column direction of the pixel units, and the sub-display areas are arranged along the row direction of the pixel units. Of course, this can be designed and determined according to the actual application environment and is not limited here.

In implementation, in the embodiments of the present disclosure, as shown in FIG. 16, the sub-display areas aa_y may be distributed in a matrix arrangement.

Figure 17:
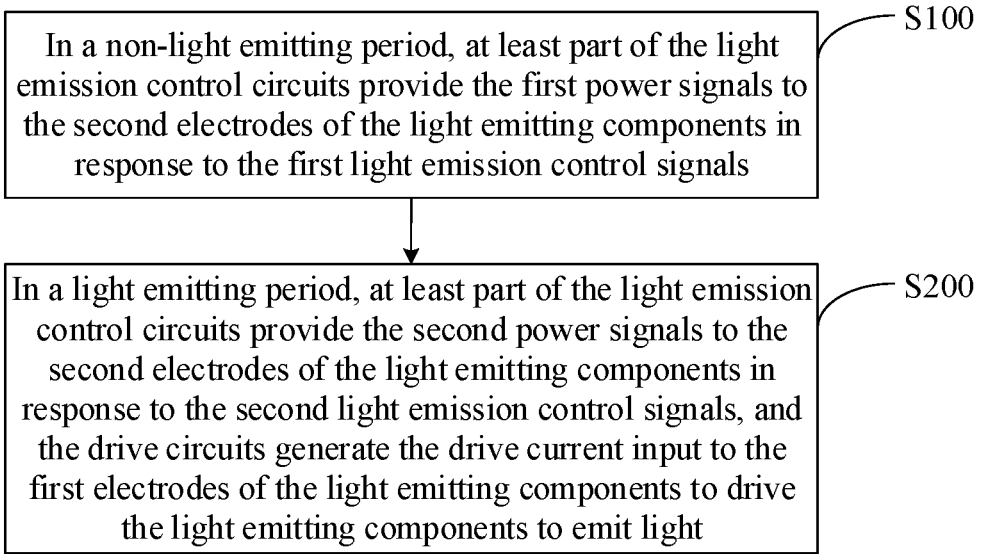
FIG. 17 is a flowchart of a driving method of the display panel in accordance with an embodiment of the present disclosure.

Based on the same inventive concept, the embodiments of the present disclosure also provide a driving method of the above display panels, as shown in FIG. 17, in one frame time, the method includes followings.

S100, in a non-light emitting period, at least part of the light emission control circuits provide the first power signals to the second electrodes of the light emitting components in response to the first light emission control signals. Specifically, all the light emission control circuits may provide the first power signals to the second electrodes of the light emitting components in response to the first light emission control signals. Alternatively, part of the light emission control circuits may provide the first power signals to the second electrodes of the light emitting components in response to the first light emission control signals. Of course, this can be designed and determined according to the actual application environment and is not limited here.

S200, in a light emitting period, at least part of the light emission control circuits provide the second power signals to the second electrodes of the light emitting components in response to the second light emission control signals, and the drive circuits generate the drive current input to the first electrodes of the light emitting components to drive the light emitting components to emit light. Specifically, all the light emission control circuits may provide the second power signals to the second electrodes of the light emitting components in response to the second light emission control signals, and all the drive circuits generate the drive current input to the first electrodes of the light emitting components to drive the light emitting components to emit light. Alternatively, part of the light emission control circuits may provide the second power signals to the second electrodes of the light emitting components in response to the second light emission control signals, and the drive circuits corresponding to the light emission control circuits generate the drive current input to the first electrodes of the light emitting components to drive the light emitting components to emit light. Of course, this can be designed and determined according to the actual application environment and is not limited here.

In implementation, in the embodiments of the present disclosure, the non-light emitting period may include the following periods.

In a reset period, all the third transistors are turned on simultaneously in response to the signals of the scanning signal terminals, to provide the reference voltage signals of the data signal terminals to the gates of the drive transistors, and all the fourth transistors are turned on simultaneously in response to the signals of the reset signal terminals, to provide the signals of the initialization signal terminals to the first electrodes of the light emitting components.

In a threshold compensation period, all the third transistors are turned on simultaneously in response to the signals of the scanning signal terminals, to provide the reference voltage signals of the data signal terminals to the gates of the drive transistors, and all the drive transistors are turned on simultaneously to write the threshold voltage of the drive transistors into the second electrodes of the drive transistors.

In a data writing period, the third transistors are turned on row by row in response to the signals of the scanning signal terminals, to provide the data signals of the data signal terminals to the gates of the drive transistors, and to write the voltage of the data signals into the second electrodes of the drive transistors through the first capacitors and the second capacitors.

The driving principle and implementation of the driving method of the display panel are the same as the principle and implementation of the display panel in the above embodiment, therefore, the driving method of the display panel can be implemented with reference to the implementation of the display panel in the above embodiment, which will not be repeated here.

Based on the same inventive concept, the embodiments of the present disclosure also provide a display device, including the above display panel according to the embodiments of the present disclosure. The principle of the display device for problem solving is similar to that of the aforementioned display panel, so the display device can be implemented with reference to the implementation of the aforementioned display panel, which will not be repeated here.

Figure 18:
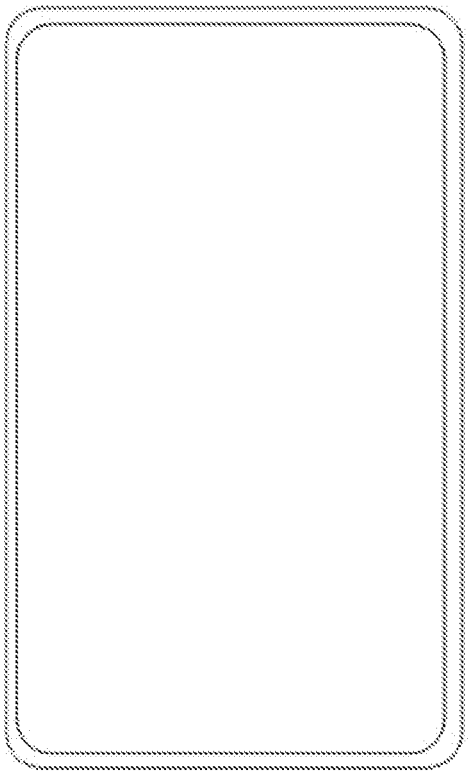
FIG. 18 is a schematic structural diagram of a display device in accordance with an embodiment of the present disclosure.

In implementation, the display device according to the embodiments of the present disclosure may be a mobile phone as shown in FIG. 18. Of course, the display device according to the embodiments of the present disclosure can also be any product or component with a display function such as a tablet computer, a television, a display, a notebook computer, a digital photo frame, and a navigator. Other essential components of the display device should be understood by those of ordinary skilled in the art, and are not described in detail herein, nor should they be taken as limitations to the present disclosure.

According to the pixel compensation circuit, the display panel, the driving method and the display device according to the embodiments of the present disclosure, in the non-light emitting period, the light emission control circuits provide the first power signals to the second electrodes of the light emitting components in response to the first light emission control signals, so as to control the light emitting components not to emit light. In the light emitting period, the drive circuits generate the drive current input to the first electrodes of the light emitting components, and the light emission control circuits provide the second power signals to the second electrodes of the light emitting components in response to the second light emission control signals, so that the drive current drives the light emitting components to emit light. Therefore, a simple structure can be adopted to control whether the light emitting components emit light, thereby reducing the process difficulty, reducing the production cost, reducing the occupied area of the pixel compensation circuit and being beneficial to the high resolution of the display panel.

Evidently those skilled in the art can make various modifications and variations to the invention without departing from the spirit and scope of the invention. Thus the invention is also intended to encompass these modifications and variations therein as long as these modifications and variations come into the scope of the claims of the invention and their equivalents.

The invention claimed is:

1. A display panel, comprising a base substrate and a plurality of pixel compensation circuits, wherein:

each of the plurality of pixel compensation circuits comprises:

a light emitting component;

a drive circuit configured to generate a drive current input to a first electrode of the light emitting component; and a light emission control circuit configured to provide a first power signal to a second electrode of the light emitting component in response to a first light emission control signal, and to provide a second power signal to the second electrode of the light emitting component in response to a second light emission control signal, wherein the first power signal and the second power signal have opposite levels;

the base substrate comprises:

a display area and a non-display area surrounding the display area; and drive circuits and light emitting components in the pixel compensation circuits are in the display area of the base substrate;

wherein the display area comprises a plurality of sub-display areas, and all the light emitting components in each sub-display area are coupled to the same light emission control circuit, and the sub-display areas one-to-one correspond to the light emission control circuits, and the light emission control circuits are in the corresponding sub-display areas respectively on the base substrate;

wherein the drive circuit comprises a plurality of drive transistors, third transistors, fourth transistors, first capacitors, and second capacitors;

wherein the light emission control circuit is further configured to provide a driving method, wherein in one frame time, the method comprises:

in a non-light emitting period, providing, by at least part of light emission control circuits, first power signals to second electrode of light emitting components in response to first light emission control signals; and in a reset period, all third transistors are turned on simultaneously in response to signals of scanning signal terminals, to provide reference voltage signals of data signal terminals to gates of drive transistors, and all fourth transistors are turned on simultaneously in response to signals of reset signal terminals, to provide signals of initialization signal terminals to the first electrodes of the light emitting components;

in a threshold compensation period, all the third transistors are turned on simultaneously in response to the signals of the scanning signal terminals, to provide the reference voltage signals of the data signal terminals to the gates of the drive transistors, and all the drive transistors are turned on simultaneously to write threshold voltages of the drive transistors into second electrodes of the drive transistors; and in a data writing period, the third transistors are turned on row by row in response to the signals of the scanning signal terminals, to provide data signals of the data signal terminals to the gates of the drive transistors, and to write voltages of the data signals into the second electrodes of the drive transistors through first capacitors and second capacitors.

2. The display panel according to claim 1, further comprising at least one of a driving chip, a flexible printed circuit, and a printed circuit board; and light emission control circuits are in at least one of the driving chip, the flexible printed circuit and the printed circuit board.

3. The display panel according to claim 1, wherein each of the sub-display areas extends in a first direction, the sub-display areas are arranged in a second direction, and the first direction crosses the second direction.

4. The display panel according to claim 1, wherein the sub-display areas are distributed in a matrix arrangement.

5. The display panel according to claim 1, wherein all the pixel compensation circuits share one light emission control circuit.

6. The display panel according to claim 1, further comprising a plurality of gate lines, a gate drive circuit, and multiplexer circuits one-to-one corresponding to the gate lines;

each of the gate lines is coupled to a signal output terminal of the gate drive circuit through the corresponding multiplexer circuit; and the multiplexer circuit is configured to connect a fixed voltage signal terminal to the corresponding gate line in response to a conduction control signal having a first level, and connect the signal output terminal to the corresponding gate line in response to a conduction control signal having a second level.

7. The display panel according to claim 6, wherein the conduction control signals received by the multiplexer circuits are the same signal.

8. A display device, comprising the display panel according to claim 1.

9. A driving method of the display panel according to claim 1, wherein in one frame time, the method comprises:

in a light emitting period, providing, by at least part of the light emission control circuits, second power signals to the second electrodes of the light emitting components in response to second light emission control signals, and generating, by the drive circuits, drive currents input to first electrodes of the light emitting components to drive the light emitting components to emit light.

10. The display panel according to claim 1, wherein the drive circuit and the light emitting component are in the display area of the display panel.

11. The display panel according to claim 1, wherein the light emission control circuit comprises a first transistor and a second transistor;

a gate of the first transistor is configured to receive the first light emission control signal, a first electrode of the first transistor is configured to receive the first power signal, and a second electrode of the first transistor is coupled to the second electrode of the light emitting component; and a gate of the second transistor is configured to receive the second light emission control signal, a first electrode of the second transistor is configured to receive the second power signal, and a second electrode of the second transistor is coupled to the second electrode of the light emitting component.

12. The display panel according to claim 11, wherein the first light emission control signal and the second light emission control signal are same signal, and transistor types of the first transistor and the second transistor are different.

13. The display panel according to claim 11, wherein the first light emission control signal is different from the second light emission control signal, and transistor types of the first transistor and the second transistor are the same.

14. The display panel of claim 1, wherein a gate of the drive transistor is coupled to a first terminal of the first capacitor, a first electrode of the drive transistor is configured to receive the first power signal, and a second electrode of the drive transistor is coupled to the first electrode of the light emitting component;

a gate of the third transistor is coupled to a scanning signal terminal, a first electrode of the third transistor is coupled to a data signal terminal, and a second electrode of the third transistor is coupled to the gate of the drive transistor;

a gate of the fourth transistor is coupled to a reset signal terminal, a first electrode of the fourth transistor is coupled to an initialization signal terminal, and a second electrode of the fourth transistor is coupled to the first electrode of the light emitting component;

a second terminal of the first capacitor is coupled to the first electrode of the light emitting component; and a first terminal of the second capacitor is configured to receive the first power signal, and a second terminal of the second capacitor is coupled to the first electrode of the light emitting component.

* * * * *